US006917265B2

(12) United States Patent
Almeida et al.

(10) Patent No.: US 6,917,265 B2
(45) Date of Patent: Jul. 12, 2005

(54) MICROWAVE FREQUENCY SURFACE MOUNT COMPONENTS AND METHODS OF FORMING SAME

(75) Inventors: Antonio Almeida, Clark, NJ (US); Shankar Joshi, Warren, NJ (US); Meta Rohde, Upper Saddle River, NJ (US); Mahadevan Sridharan, Piscataway, NJ (US)

(73) Assignee: Synergy Microwave Corporation, Paterson, NJ (US)

( * ) Notice: Subject to any disclaimer, the term of this patent is extended or adjusted under 35 U.S.C. 154(b) by 105 days.

(21) Appl. No.: 10/443,510

(22) Filed: May 22, 2003

(65) Prior Publication Data

US 2004/0233024 A1 Nov. 25, 2004

(51) Int. Cl.[7] ..... H11P 5/08
(52) U.S. Cl. ..... 333/246; 333/238; 333/164
(58) Field of Search ..... 333/246, 238, 333/164, 38

(56) References Cited

U.S. PATENT DOCUMENTS

| | | | | |
|---|---|---|---|---|
| 4,768,004 A | | 8/1988 | Wilson | |
| 4,821,007 A | | 4/1989 | Fields et al. | |
| 4,853,660 A | * | 8/1989 | Schloemann | 333/246 |
| 5,014,023 A | * | 5/1991 | Mantele | 333/164 |
| 5,355,102 A | * | 10/1994 | Kornrumpf et al. | 333/246 |
| 6,037,650 A | * | 3/2000 | Ioffe et al. | 257/596 |
| 6,201,459 B1 | * | 3/2001 | Ioffe et al. | 333/246 |
| 6,525,623 B2 | | 2/2003 | Sridharan et al. | |
| 6,529,105 B1 | * | 3/2003 | Cachier et al. | 333/246 |

FOREIGN PATENT DOCUMENTS

| | | |
|---|---|---|
| EP | 0023400 A1 | 4/1981 |
| EP | 039152 A1 | 11/1990 |
| EP | 0434847 A1 | 7/1991 |
| EP | 1085594 A2 | 3/2001 |

* cited by examiner

*Primary Examiner*—Michael Tokar
*Assistant Examiner*—Lam T. Mai
(74) *Attorney, Agent, or Firm*—Lerner, David, Littenberg, Krumholz & Mentlik, LLP

(57) ABSTRACT

A microwave frequency device includes: a first substrate having a dielectric layer and a conductive film disposed on opposing first and second sides of the dielectric layer, the conductive film on the first side of the dielectric layer of the first substrate including at least one signal line; and a second substrate having a dielectric layer, conductive film disposed on at least one of first and second opposing sides of the dielectric layer, and at least one cut-out where the dielectric layer and conductive film have been removed, wherein the first and second substrates are bonded together to form a bonded assembly such that (i) a portion of the signal line of the first substrate is sandwiched between the dielectric layers of the first and second substrates, and (ii) the at least one cut-out exposes a portion of the signal line, thereby forming a microstrip portion. A method of forming same is also disclosed.

40 Claims, 22 Drawing Sheets

200

MICROWAVE FREQUENCY SURFACE MOUNT COMPONENTS AND METHODS OF FORMING SAME

BACKGROUND OF THE INVENTION

The present invention relates to microwave frequency devices and methods of fabricating same.

Microwave frequency components, including surface mount components, are increasingly being used to provide transmission lines and other circuit functions that are useful to designers of larger systems. Strip line and microstrip techniques are often used to implement these microwave frequency devices.

The microstrip technique is characterized by a planar transmission line conductor disposed on a dielectric layer and spaced apart from a conducting ground plane. This construction establishes an impedance and a velocity factor of the transmission line, which are functions of such factors as the dielectric characteristics of the dielectric layer and other surrounding materials, a width of the planar transmission line conductor, and the distance from the planar transmission line conductor to the conductive ground plane.

The strip line technique is generally characterized by a planar transmission line conductor sandwiched between two dielectric layers and between two conductive ground planes on opposite sides of the dielectric layers. This construction provides a shield around the planar transmission line vis-à-vis the two conductive ground planes that sandwich the transmission line. This construction also establishes an impedance and a velocity factor of the transmission line, which are functions of such factors as the dielectric characteristics of the dielectric layer and other surrounding materials, a width of the planar transmission line conductor, and the distance from the planar transmission line conductor to the conductive ground planes.

Among the concerns of a designer of microwave frequency devices and larger systems in which such devices are utilized, are the mechanisms by which microwave signals are input to and output from the microwave frequency devices. For example, a microwave frequency device (such as a directional coupler, a power divider, etc.) fabricated utilizing strip line technology may be part of an overall system containing other components. Interconnections between the directional coupler and other devices of the system may be made by way of a printed circuit board (PCB), where connecting traces are formed utilizing the microstrip technique. Under these circumstances, the planar transmission line conductors of the microwave frequency devices of the system are electrically connected to the traces of the printed circuit board.

U.S. Pat. No. 4,821,007 ("the '007 patent") provides an illustrative example of the electrical interconnections between a strip line microwave frequency device that is surface mounted to a printed circuit board. The '007 patent is hereby incorporated by reference in its entirety. In accordance with the '007 patent, the electrical connections between the planar transmission line conductors of the strip line microwave frequency device and the traces of the printed circuit board are made by way of portions of plated through-holes passing through a laminar assembly. The plated through-holes are bisected during the manufacturing process to expose the portions of the plated through-holes at a peripheral edge of the structure.

More particularly, the laminar assembly disclosed in the '007 patent includes one or more planar transmission lines sandwiched between two dielectric layers and two outer ground planes disposed on opposite sides of the dielectric layers. A series of holes are drilled through the laminar assembly (i.e., through the two dielectric layers) such that they intersect the planar transmission lines. The through-holes are then plated such that an electrical connection is made between the plating and the planar transmission lines. The laminar assembly is then cut along lines that bisect the through-holes such that portions of the plated through-holes are exposed. The planar transmission lines of the laminar assembly are electrically connected to the traces of the printed circuit board by soldering the plating of the exposed through-holes to the traces.

Unfortunately, plated through-holes are notoriously unreliable and often fail. Indeed, as the number of layers through which a through-hole passes increases, the reliability of the through-hole decreases exponentially. Therefore, the connection of a multi-layer microwave frequency device to a printed circuit board utilizing an exposed plated through-hole as described in the '007 patent presents a problem. Indeed, the transfer of a microwave signal from the microwave frequency device to the printed circuit board, or vice versa, may not be reliable. Further, abrupt changes in geometry from a planar transmission line of a microwave frequency device, to the plated portion of an associated multi-layer through-hole, and to a trace of a printed circuit board, are prone to produce impedance mismatches and resultant undesirable signal reflections.

Still further, the use of the strip line technique in signal transmission has an inherent limitation on power handling capability inasmuch as the widths of the planar transmission lines are relatively small for a given impedance. Indeed, a plated through-hole (like that used in the '007 patent) may be of about 50 mils (0.050 inches) in diameter, while the planar transmission line may be about 10 mils (0.010 inches) wide. Mismatches caused by radical geometry changes at the plated through-hole to PCB junction will cause high temperatures at the planar transmission line. Since the planar transmission line is only 10 mils wide, it might fuse. Therefore, maintaining a strip line construction within a microwave frequency device to the interconnection of the planar transmission lines and the traces of the printed circuit board limits the power handling capability of the device, particularly at the interconnection points.

While impedance mismatching can sometimes be compensated for by tuning techniques (e.g., adding capacitance or inductance at key positions in the circuit), the construction of the '007 patent does not provide for such action on the microwave frequency device. Employing tuning techniques on the PCB is not a practical solution because system manufacturers expect that the device to operate "as advertised" without requiring tuning after assembly to the PCB.

Accordingly, there are needs in the art for new microwave frequency devices, and methods of manufacturing same, which provide different mechanisms for interconnecting the microwave frequency devices to the traces of a printed circuit board, preferably mechanisms that enjoy enhanced power handling capability and the ability to tune the signal lines at the interconnection point to adjust for impedance mismatches and reduce signal reflections.

SUMMARY OF THE INVENTION

In accordance with one or more aspects of the present invention, a microwave frequency device includes a substrate having a dielectric layer and a conductive film disposed on opposing first and second sides of the dielectric layer, the conductive film on the first side of the dielectric layer including one or more signal lines; and a microwave frequency component having opposing first and second sides, the second side being coupled to the first side of the substrate, the microwave frequency component including input/output nodes coupled to the signal lines, wherein the one or more signal lines of the substrate form respective microstrip portions.

In accordance with one or more further aspects of the present invention, a microwave frequency device includes: a first substrate having a dielectric layer and a conductive film disposed on opposing first and second sides of the dielectric layer, the conductive film on the first side of the dielectric layer of the first substrate including at least one signal line; and a second substrate having a dielectric layer, conductive film disposed on at least one of first and second opposing sides of the dielectric layer, and at least one cut-out where the dielectric layer and conductive film have been removed. The first and second substrates are bonded together to form a bonded assembly such that (i) a portion of the signal line of the first substrate is sandwiched between the dielectric layers of the first and second substrates, and (ii) the at least one cut-out exposes a portion of the signal line, thereby forming a microstrip portion.

The exposed portion of the signal line preferably terminates at a peripheral edge of the first substrate of the bonded assembly; and the peripheral edge adjacent to the exposed portion of the signal line is preferably plated such that it is electrically coupled to the signal line. The plated peripheral edge of the first substrate adjacent to the exposed portion of the signal line may be curved. Preferably, the exposed portion of the signal line at the peripheral edge of the first substrate is wider than non-exposed portions of the signal line. The at least one cut-out is operable to permit tuning actions to take place at the exposed portion of the signal line.

In alternative embodiments, the conductive film on the first side of the dielectric layer of the first substrate includes at least one ground conductor; and the at least one cut-out of the second substrate includes a cut-out that exposes a portion of the ground conductor. Preferably, the exposed portion of the ground conductor terminates at the peripheral edge of the first substrate of the bonded assembly, the peripheral edge adjacent to the exposed portion of the ground conductor being plated such that it is electrically coupled to the ground conductor. The plated peripheral edge of the first substrate adjacent to the exposed portion of the ground conductor may be curved.

In accordance with the invention, the microwave frequency device may be a coupler, a directional coupler, a bi-directional coupler, a power divider, a phase shifter, a frequency synthesizer, a frequency doubler, an attenuator, or a transformer.

In accordance with one or more further aspects of the present invention, a microwave frequency device includes: a first substrate having a dielectric layer circumscribed by a peripheral edge and a conductive film disposed on opposing first and second sides of the dielectric layer, the conductive film on the first side of the dielectric layer of the first substrate including at least one signal line, respective ends of the at least one signal line terminating at the peripheral edge; and a second substrate having a dielectric layer, conductive film disposed on at least one of first and second opposing sides of the dielectric layer, and respective cut-outs where the dielectric layer and conductive film have been removed. Preferably, the first and second substrates are bonded together to form a bonded assembly such that (i) respective portions of the at least one signal line of the first substrate are sandwiched between the dielectric layers of the first and second substrates, and (ii) the respective cut-outs expose the ends of the signal lines, thereby forming respective microstrip portions.

The peripheral edge adjacent to the respective ends of the at least one signal line is plated to form respective connection points to the at least one signal line. The plated peripheral edge of the first substrate adjacent to the respective ends of the at least one signal line may be curved.

Preferably, the exposed portions of the signal lines at peripheral edges of the first substrate are wider than non-exposed portions of the signal lines. The cut-outs are preferably operable to permit tuning actions to take place at the exposed portions of the signal lines.

The conductive film on the first side of the dielectric layer of the first substrate preferably includes at least one ground conductor; and the cut-outs of the second substrate preferably include a cut-out that exposes a portion of the ground conductor. The exposed portion of the ground conductor terminates at the peripheral edge of the first substrate of the bonded assembly, the peripheral edge adjacent to the exposed portion of the ground conductor being plated such that it is electrically coupled to the ground conductor. The plated peripheral edge of the first substrate adjacent to the exposed portion of the ground conductor may be curved.

In accordance with one or more further aspects of the present invention, a method of forming a microwave frequency device includes providing a substrate having a dielectric layer and a conductive film disposed on opposing first and second sides of the dielectric layer, the conductive film on the first side of the dielectric layer including one or more signal lines; disposing a microwave frequency component, having opposing first and second sides and input/output nodes, onto the first side of the substrate; and coupling the input/output nodes of the microwave frequency component to the signal lines of the substrate such that the one or more signal lines of the substrate form respective microstrip portions.

In accordance with one or more further aspects of the present invention, a method includes: providing a first substrate having a dielectric layer and a conductive film disposed on opposing first and second sides of the dielectric layer; patterning the conductive film on the first side of the dielectric layer of the first substrate to form at least one signal line; providing a second substrate having a dielectric layer, and conductive film disposed on at least one of first and second opposing sides of the dielectric layer; removing the dielectric layer and conductive film in at least one region of the second substrate to form at least one cut-out; and bonding the first and second substrates together to form a bonded assembly such that (i) a portion of the signal line of the first substrate is sandwiched between the dielectric layers of the first and second substrates, and (ii) the at least one cut-out exposes a portion of the signal line, thereby forming a microstrip portion.

The method may further include: forming a through-hole through the first substrate that intersects the exposed portion of the signal line; plating a sidewall of the through-hole with conductive material to obtain an electrical connection with the exposed portion of the signal line; and cutting the bonded assembly along at least one line that intersects the through-hole to form a peripheral edge. Preferably, the method further includes electrically connecting a remaining portion of the plated sidewall of the through-hole to an external bonding pad to couple the signal line to external circuitry.

In accordance with one or more further aspects of the present invention, the methods and/or apparatus may include employing a second substrate having a dielectric layer, conductive film disposed on at least one of first and second opposing sides of the dielectric layer, and at least one cut-out formed from an absence of the conductive film, but leaving at least some of the dielectric layer, in at least one region of the second substrate. In this regard, the at least one cut-out in the conductive film of the second substrate is in registration with a portion of the signal line, thereby forming a microstrip portion.

Other aspects, features, advantages, etc., of the invention will become apparent to those skilled in the art when the description herein is considered in conjunction with the accompanying drawings.

BRIEF DESCRIPTION OF THE DRAWINGS

For the purposes of illustrating the invention, there are shown in the drawings forms that are presently preferred. It being understood, however, that the present invention is not limited to the precise arrangements and instrumentalities shown.

DETAILED DESCRIPTION OF THE INVENTION

Figure 1:
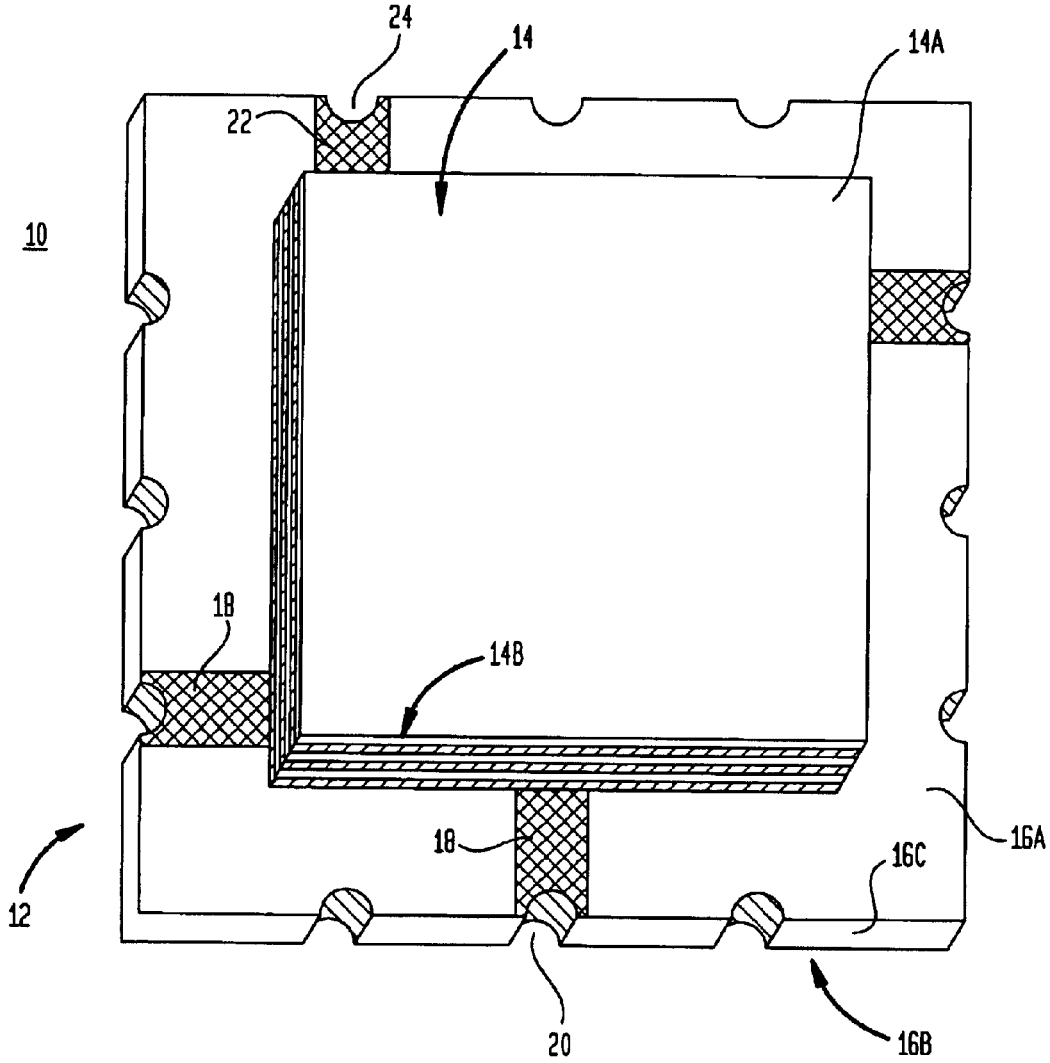
FIG. 1 is a perspective view of a microwave frequency device in accordance with one or more aspects of the present invention.

Referring now to the drawings, wherein like numerals indicate like elements, there is shown in FIG. 1, a perspective view of a microwave frequency device 10 in accordance with one or more aspects of the present invention. The microwave frequency device 10 includes a substrate 12 and a microwave frequency component 14. The substrate includes a single dielectric layer 16 and conductive film disposed on opposing first and second sides 16A, 16B of the dielectric layer 16. The conductive film on the first side 16A of the dielectric layer 16 includes one or more signal lines 18 that preferably terminate at peripheral edges of the substrate 12.

The microwave frequency component 14 includes a first side 14A and an opposing second side (which cannot be seen in FIG. 1). The second side of the microwave frequency component 14 is coupled to the first side 16A of the substrate 12. The microwave frequency component 14 includes one or more input and/or output nodes that are coupled to respective ones of the signal lines 18.

Preferably, the microwave frequency component 14 and the substrate 12 are sized and shaped such that one or more of the signal lines 18 of the substrate 12 form respective microstrip portions. By way of example, the first and second sides 16A, 16B and the peripheral sides of the substrate 12 form a first parallelepiped. Similarly, the first and second sides and peripheral sides of the microwave frequency component 14 form a second parallelepiped. At least one peripheral side of the microwave frequency component 14, such as side 14B, is not coplanar with a corresponding one of the peripheral sides of the substrate 12, such as side 16C. In this way, signal lines 18 form respective microstrip portions inasmuch as they are not sandwiched between the dielectric layer 12 and any other dielectric layer.

In accordance with the invention, any number of the peripheral sides of the microwave frequency component 14 may be set back from (not coplanar with) the corresponding peripheral sides of the substrate 12. Indeed, as shown in FIG. 1, all four peripheral sides of the microwave frequency component 14 are set back from the corresponding peripheral sides of the substrate 12.

Preferably, the peripheral edges (portions of the respective peripheral sides) adjacent to the signal lines 18 are plated such that they are electrically coupled to the respective signal lines 18. It is most preferred that these plated peripheral edges 20 are curved. The conductive film on the first side 16A of the dielectric layer 16 of the substrate 12 may include one or more ground conductors 22 terminating at one or more peripheral edges of the substrate 12. Preferably, one or more peripheral edges (portions of the peripheral side or sides of the substrate 12) adjacent to the ground conductor 22 are plated such that they are electrically coupled to the ground conductor 22. It is most preferred that these peripheral edges 24 are curved.

The microwave frequency device 10 is preferably electrically connected to respective traces of a printed circuit board, PCB (not shown) by soldering or otherwise connecting the microstrip portions to the traces. It is preferred that conventional surface mount techniques be employed to connect the plated curved portions 20, 24 to the traces of the PCB. Advantageously, this provides a very reliable interconnection between the microwave frequency device 10 and the PCB. Indeed, as the substrate 12 is preferably a single layer, the disadvantageous aspects of plated through-hole reliability are significantly reduced in the present invention.

Further, the interconnection between the microwave frequency device 10 and the PCB is characterized by a microstrip-to-microstrip connection. Indeed, the microstrip portions of the microwave frequency device 10 are coupled to microstrip traces of the PCB. Accordingly, abrupt changes in geometry and resultant impedance mismatches are avoided.

In the event that impedance mismatches occur in the interconnection of the signal lines 18 to the traces of the PCB, the exposed microstrip portions of the microwave frequency device 10 provide for tuning to take place on the microwave frequency device 10. Thus, if the geometry of the PCB (i.e., the widths of the traces thereof) are known in advance, steps may be taken during the manufacturing process of the microwave frequency device 10 to pre-tune the microstrip portions thereof to improve the impedance matching characteristics of the device 10 before it is mounted on a PCB. Alternatively, the tuning process may take place after the microwave frequency device 10 is mounted on the PCB. The microstrip portions of the microwave frequency device 10 provide an area on the microwave frequency device 10 itself where the tuning techniques may be employed.

Further, the widths of the signal lines 18 may be significantly wider than would be employed in a strip line device and, therefore, enhanced power handling capabilities are enjoyed by the microwave frequency device 10 in accordance with the present invention. Indeed, the wider signal lines 18 permit enhanced heat dissipation and reduced likelihood (and even elimination of) any fusing due to impedance mismatches and the like.

In accordance with the invention, the microwave frequency component 14 may be implemented utilizing any of the known microwave frequency devices, such as directional couplers, bi-directional couplers, power dividers, transformers, phase shifters, frequency synthesizers, frequency doublers, attenuators, filters, passive components, active components, etc. Further, any of the known manufacturing techniques and/or materials may be utilized to produce the microwave frequency device 10, such as utilizing a single- or multi-layer low temperature co-fired ceramic structure, a thin/thick film single- or multi-layer on illuminer structure, a single- or multi-layer polytrifluoro ethylene structure, a ceramic filled single- or multi-layer polytrifluoro ethylene structure, and a ceramic filled, glass woven, single- or multi-layer polytrifluoro ethylene structure.

The substrate 12 and the microwave frequency component 14 may be manufactured individually and bonded together in respective pairs. It is preferred, however, that an array of substrates 12 and an array of microwave frequency components 14 are manufactured and the respective arrays are bonded together to form an integral structure. Thereafter, the individual microwave frequency devices 10 may be cut from the integral structure. This process will be discussed later in this description and with respect to a specific example for the microwave frequency device 14.

Figure 2:
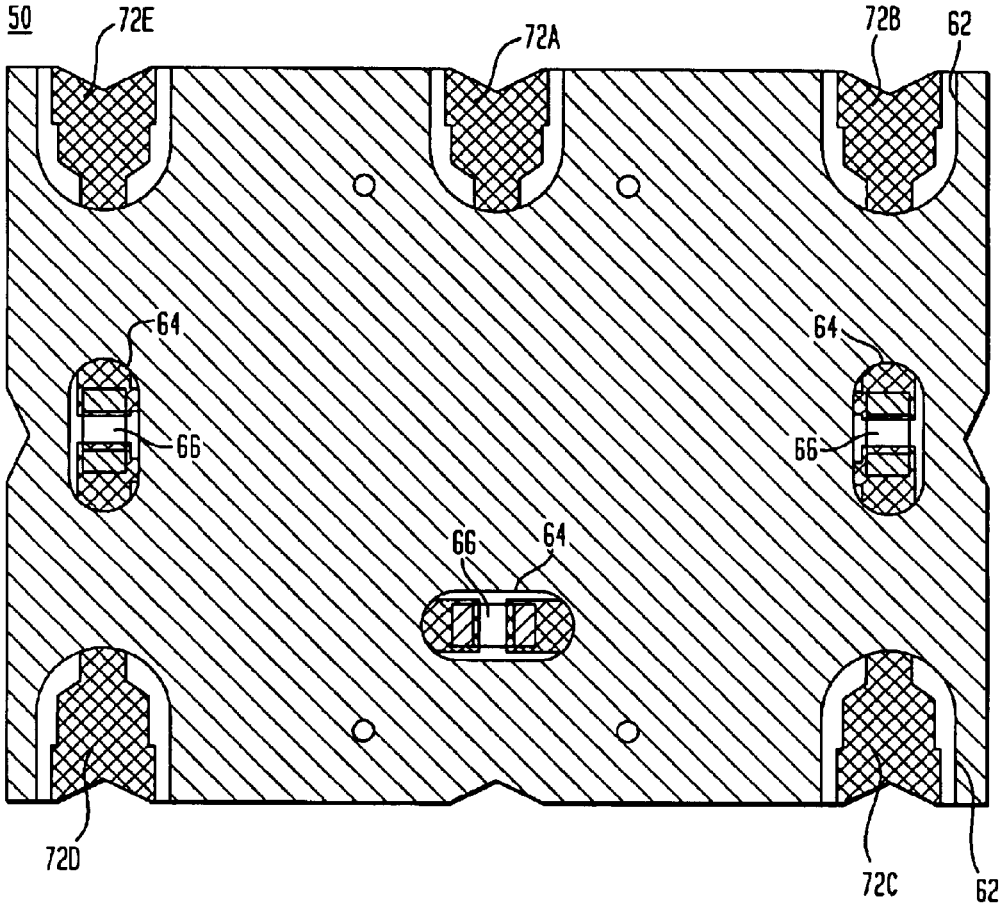
FIG. 2 is a top plan view of a microwave frequency device in accordance with one or more further aspects of the present invention.
Figure 3:
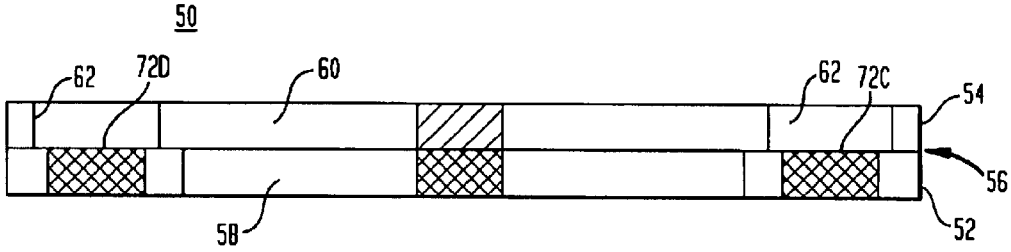
FIG. 3 is a side view of the microwave frequency device of FIG. 2.

With reference to FIG. 2 a top plan view of a microwave frequency device 50 is shown in accordance with one or more further aspects of the present invention. FIG. 3 is a side view of the microwave frequency device 50 of FIG. 2. For the purposes of discussion, the microwave frequency device 50 illustrated in FIGS. 2 and 3 is intended to be a 1:4 power divider. The microwave frequency device 50 preferably includes a first substrate 52 and a second substrate 54 that are bonded together by way of an appropriate film 56 (best seen in FIG. 8) to form a bonded assembly. The first substrate 52 preferably includes a dielectric layer 58 and conductive film disposed on opposing first and second sides of the dielectric layer 58. These features of the first substrate 52 will be discussed in more detail later in this description. The second substrate 54 also preferably includes a dielectric layer 60 and conductive film disposed on at least one of first and second opposing sides thereof. The detailed features of the second substrate 54 will also be discussed later in this description. The conductive film on one of the first and second sides of the dielectric layer 58 is sandwiched between the dielectric layers 58 and 60 to form one or more signal lines 72A–E.

Preferably, the second substrate 54 includes one or more cut-outs 62, where the dielectric layer 60 and conductive film have been removed. In accordance with one or more aspects of the present invention, the cut-outs 62 preferably expose portions of the one or more signal lines 72A–E of the dielectric layer 58 to form microstrip portions. Further cut-outs (or apertures) 64 are provided in the second substrate 54 to facilitate the disposition of respective resistors 66. As will be described in more detail hereinbelow, the microwave frequency device 50 is preferably electrically connected to respective traces of a printed circuit board (not shown) by soldering or otherwise connecting the microstrip portions 72A–E to the traces. Advantageously, this provides reliable, high-power, and tunable connections.

Figure 4:
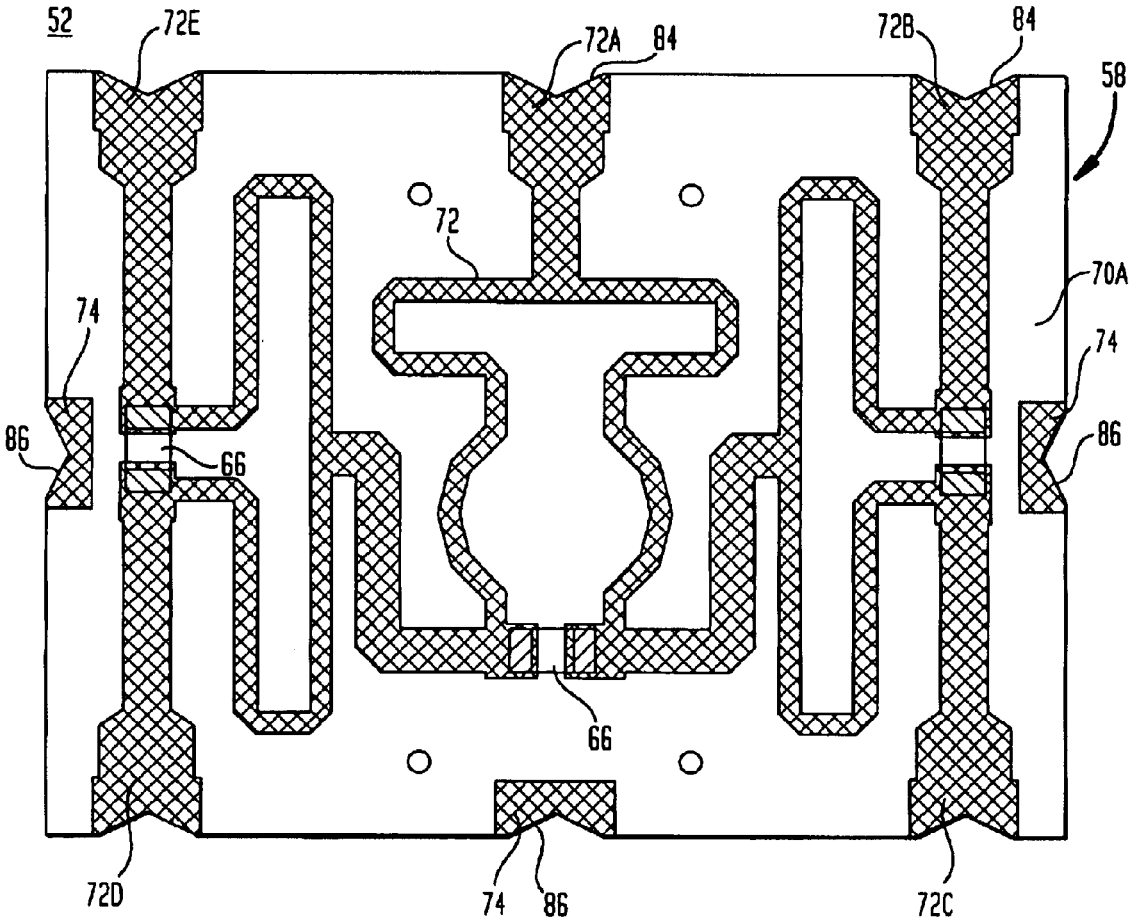
FIG. 4 is a top plan view of a substrate in accordance with one or more aspects of the present invention that is suitable for use in the microwave frequency device of FIGS. 2–3.
Figure 5:
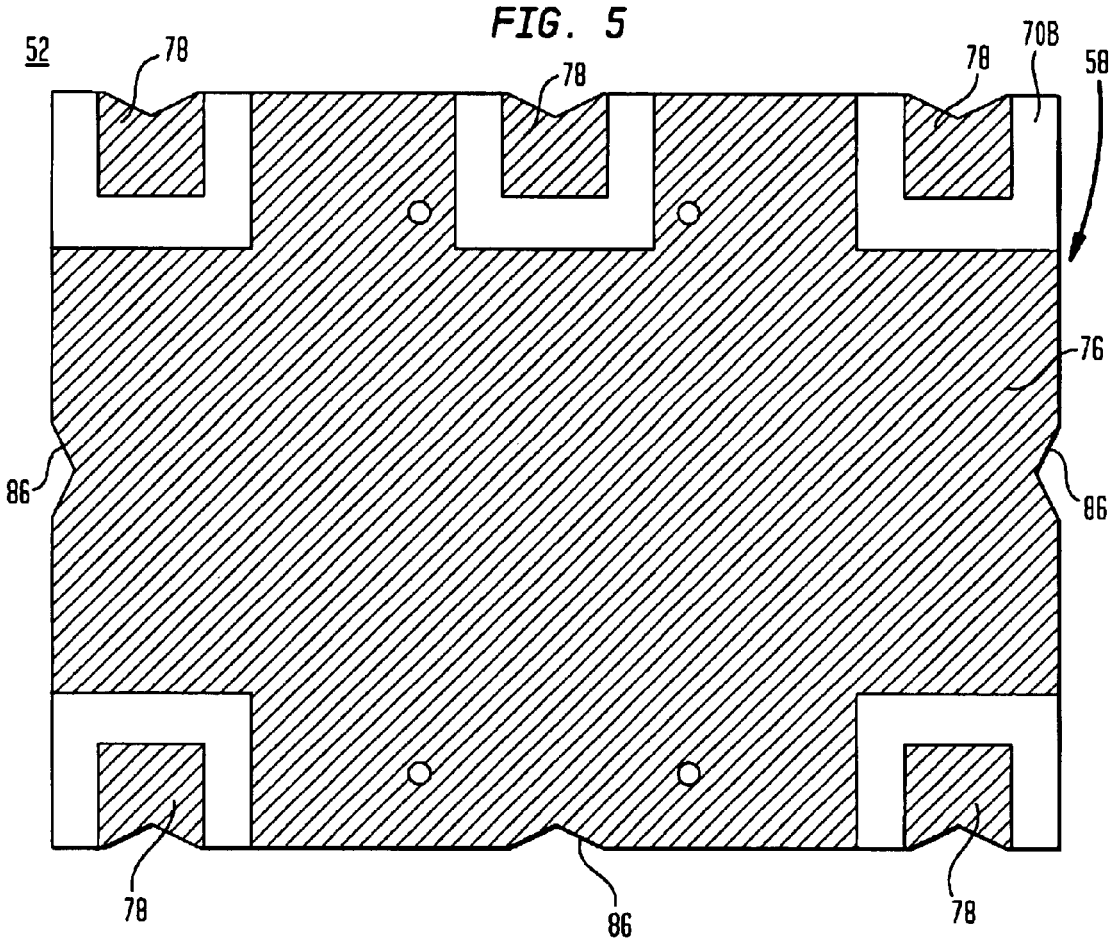
FIG. 5 is a plan view of an opposite side of the substrate of FIG. 4.

Reference is now made to FIGS. 4 and 5, which illustrate top and bottom plan views of the first substrate 52 of FIGS. 2 and 3. The substrate 52 includes the dielectric layer 58 having opposing first and second sides 70A, 70B, respectively. Conductive film is disposed on the opposing first and second sides 70A, 70B of the dielectric layer 52. As best seen in FIG. 4, the conductive film preferably includes at least one planar transmission line (or signal line) 72. For the purposes of an exemplary discussion, FIG. 4 shows one signal line 70 disposed on the dielectric layer 58, which splits several times for use in forming a microwave frequency power divider.

Respective ends of the signal lines 72A–E preferably terminate at a periphery of the substrate 58. More particularly, the signal line 72A serves as an input to the device 50, while the signal lines 72B–E are outputs and terminate at peripheral edges near respective corners of the substrate 58. Preferably, the widths of the signal lines 72A–E increase near the ends thereof to facilitate proper impedance characteristics, which will be discussed in further detail below.

Additional regions of conductive material 74 may be provided on the first side 70A of the dielectric layer 58. It is noted, however, that these further regions of conductive material 74 are not required to practice the present invention, although they may be preferred. When used, the regions 74 are electrically connected to a ground plane 76 on the second side 70B of the dielectric layer 58 utilizing either plated through-holes, edge plating, or both. This will be discussed in more detail later in this description. As best seen in FIG. 5, the conductive film on the second side 70B of the dielectric layer 58 is preferably formed into the ground plane 76. It is most preferred that isolated portions 78 of conductive film are formed in registration with (or opposite from) the ends of the signal lines 72A–E. As will be discussed in more detail later in this description, the isolated portions 78 of conductive film may be connected to the ends of the signal lines 72A–E by way of through-holes, edge plating, or both.

Figure 6:
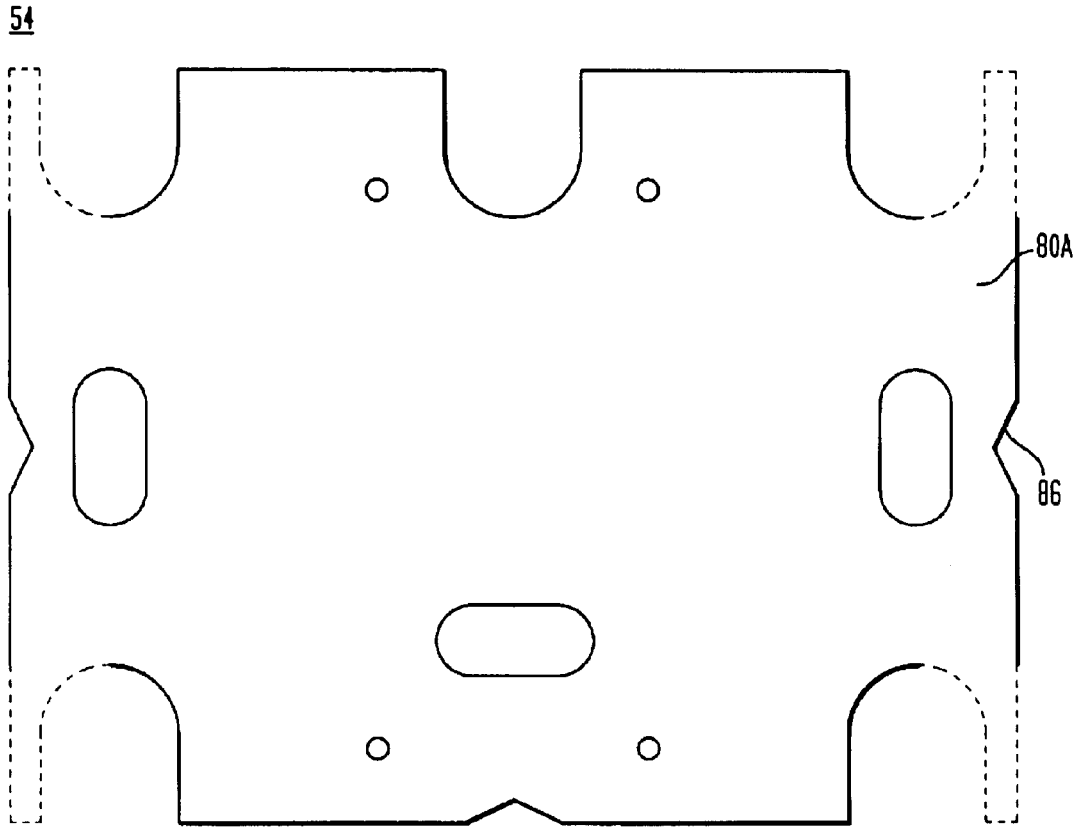
FIG. 6 is a top plan view of another substrate in accordance with various aspects of the present invention that is suitable for use with the substrate of FIGS. 4–5 to form the microwave frequency device of FIGS. 2–3.
Figure 7:
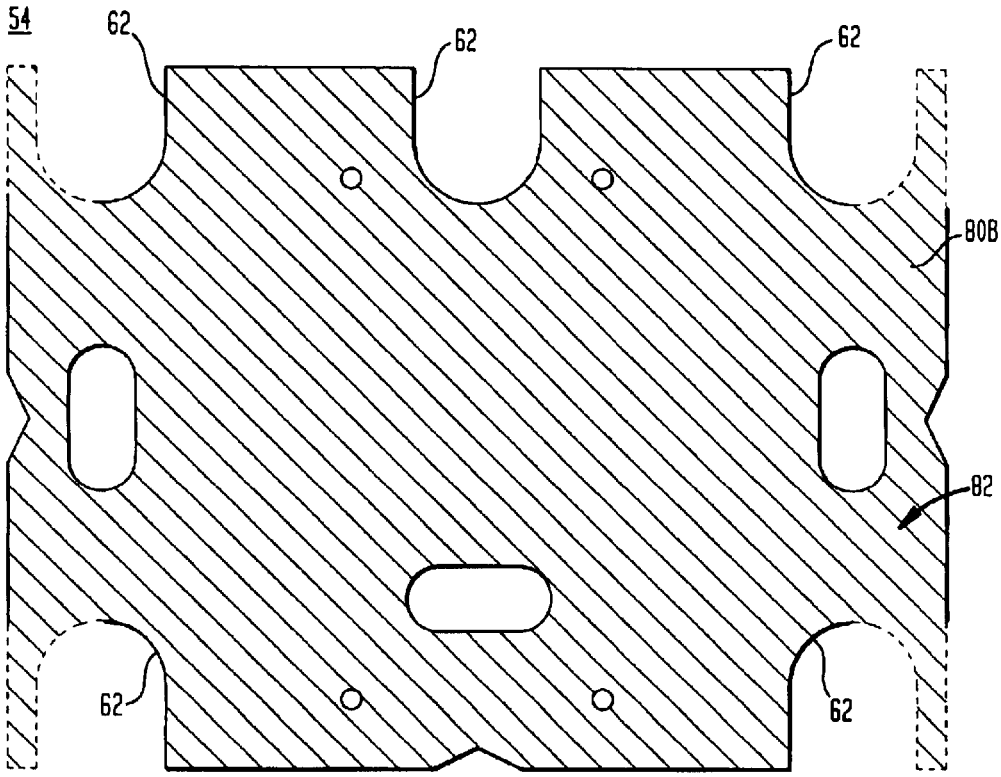
FIG. 7 is plan view of an opposite side of the substrate of FIG. 6.

With reference to FIGS. 6 and 7, the second substrate 54 includes the dielectric layer 60 having first and second opposing sides 80A, 80B, respectively. Although not required, the first side 80A of the dielectric layer 60 may include one or more regions of conductive film (not shown) disposed to be in registration with the conductive material 74 on the first substrate 52. The second side 80B of the dielectric layer 60 preferably includes conductive film forming a ground plane 82. When the regions of conductive material are disposed on the first side 80A of the dielectric layer 60, they are preferably electrically connected to the ground plane 82 on the second side 80B of the dielectric layer 60. This electrical interconnection is preferably achieved either utilizing plated through-holes, edge plating, or both.

Figure 8:
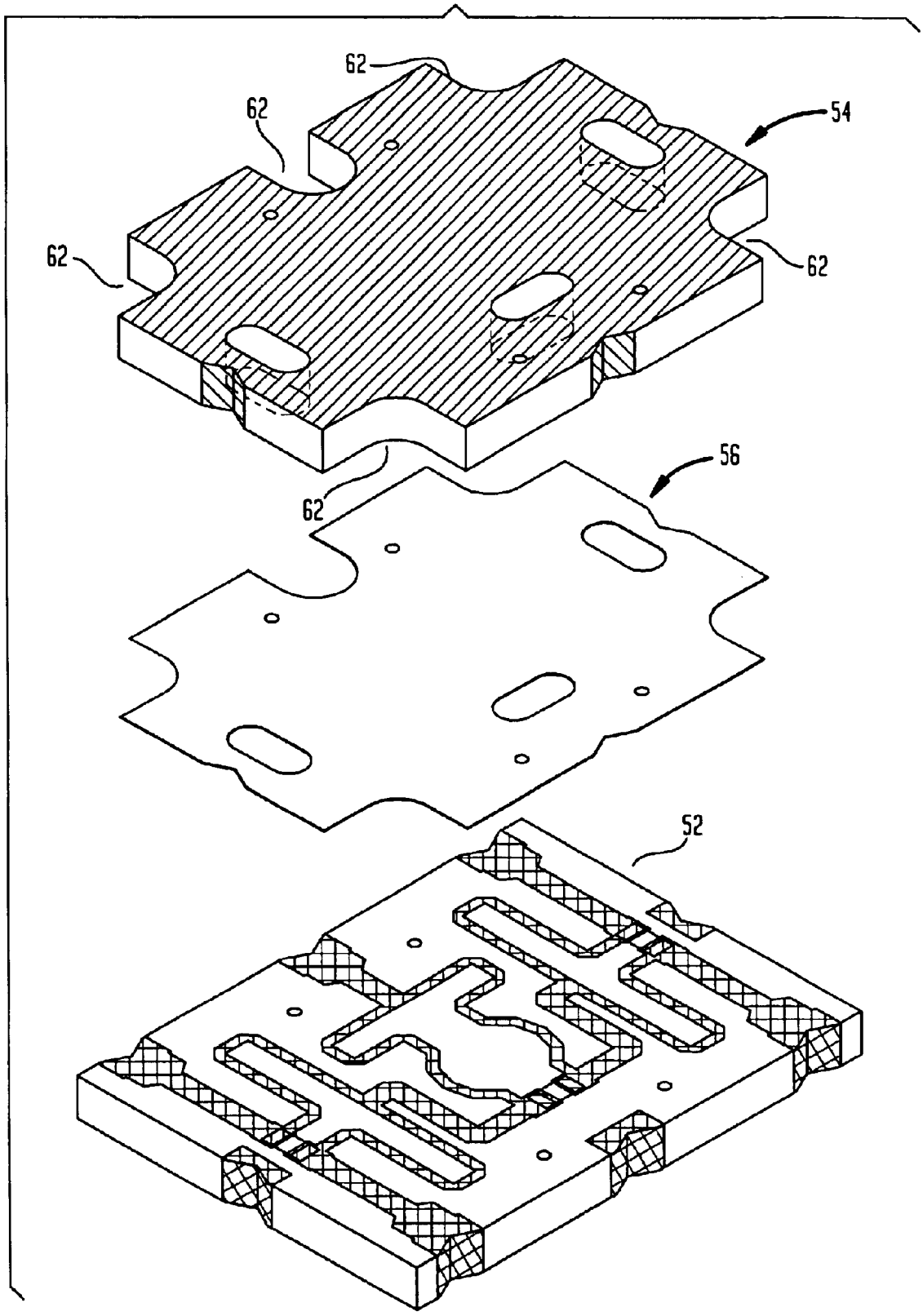
FIG. 8 is a perspective exploded view of the microwave frequency device of FIG. 2.
Figure 9:
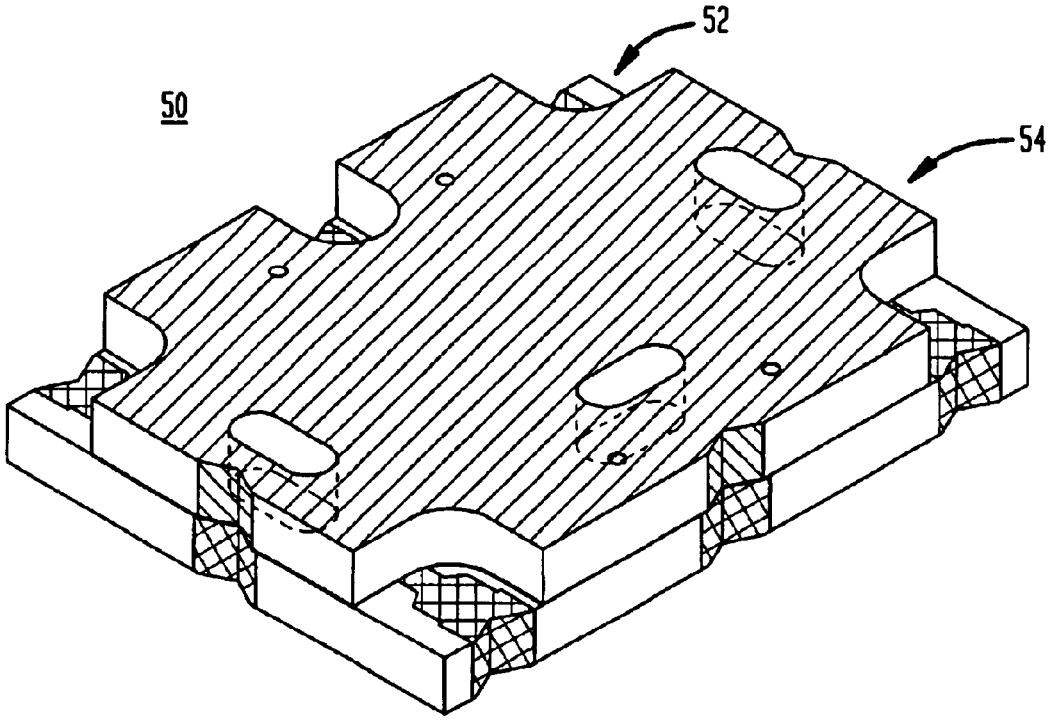
FIG. 9 is a perspective view of the assembled microwave frequency device of FIG. 2.

The second substrate 54 preferably includes the one or more cut-outs 62 along one or more peripheral edges thereof. For example, one or more cut-outs 62 may be provided at one or more respective corners of the substrate 54. As shown in dashed line, the cut-outs 62 near the corners of the second substrate 54 may be disposed along respective peripheral edges of the substrate 54. Alternatively, the cut-outs 62 may be disposed at the corner of the substrate 54, i.e., with the material in dashed line removed. This alternative construction is shown in FIGS. 8–9.

As illustrated in FIGS. 2–5, one or more curved portions 84 are provided in the peripheral edges of the dielectric layer 58 proximate to the ends of the signal lines 72A–E. Preferably, edge plating is also (or alternatively) provided to electrically connect the ends of the signal lines 72A–E to the corresponding isolated portions 78 of conductive material on the second side 70B of the dielectric layer 58. This edge plating is preferably disposed on the curved portions 84 of the first substrate 52. Plated through-holes may also be employed for this purpose. One or more further curved portions 86 may be provided in the peripheral edges of the dielectric layers 58 and 60 proximate to the regions 74. Edge plating may be employed between the regions 74 and the ground plane 76 along the peripheral edge or edges of the dielectric substrate 58 to interconnect the regions 74 to the ground plane 76. Further, edge plating may be employed at the curved portions 86 of the dielectric substrate 60 to interconnect the ground plane 76 to the ground plane 82.

As explained above, the microwave frequency device 50 is preferably electrically connected to the respective traces of the printed circuit board by soldering or otherwise connecting the microstrip portions of the signal lines 72A–E to the traces. It is most preferred that the electrical connections of the signal lines 72A–E to the traces of the printed circuit board are established by soldering or otherwise connecting the edge plated curved portions 84 of the first substrate 52 to the traces of the printed circuit board. Advantageously, this provides reliable, high-power, and tunable connections between the microwave frequency device 50 and the printed circuit board.

Owing to the cut-outs 62, the ends of the signal lines 72A–E are exposed and actions may be taken to correct for any impedance mismatches resulting from the connection of the signal lines 72A–E to the traces of the printed circuit board. For example, some of the conductive material at the ends of the signal lines 72A–E may be removed or trimmed to correct for impedance mismatches. Alternatively, conductive material may be added in the connection region to correct for impedance mismatches.

Other portions of the microwave frequency device 50 may also be connected to the traces of the printed circuit board. For example, ground connections may be achieved by soldering or otherwise connecting one or more of the edge plated curved portions 86 to respective traces of the printed circuit board. It is preferred that conventional surface mount techniques be employed to connect the plated curved portions 86 (and the plated curved portions 84) to the traces of the printed circuit board.

With reference to FIG. 8, the first and second substrates 52, 54 are preferably bonded together by way of the bonding film 56 such that the first side 70A of the first substrate 52 is adjacent to the first side 80A of the second substrate 54. The cut-outs 62 are preferably in registration with the ends of the signal lines 72A–E such that they are exposed in the bonded assembly. A perspective view of the completed bonded assembly of the microwave frequency device 50 is shown in FIG. 9.

Figure 10:
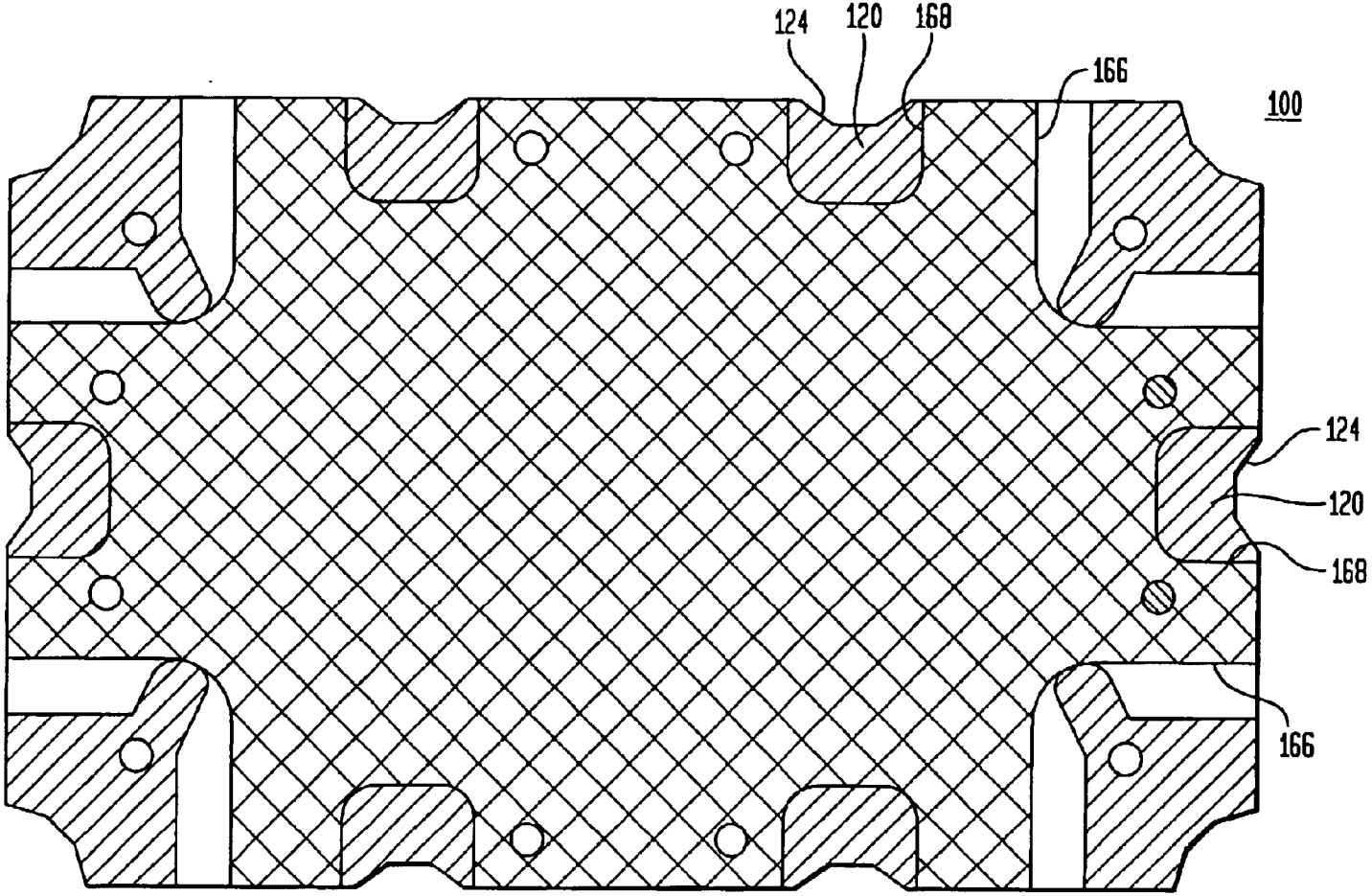
FIG. 10 is a top plan view of a microwave frequency device in accordance with one or more further aspects of the present invention.
Figure 11:
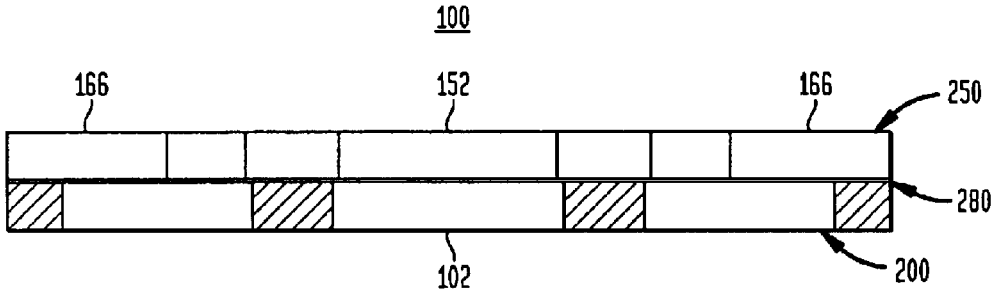
FIG. 11 is a side view of the microwave frequency device of FIG. 10.

Reference is now made to FIG. 10, which is a top plan view of a microwave frequency device 100 in accordance with one or more further aspects of the present invention. FIG. 11 is a side view of the microwave frequency device 100 of FIG. 10. For the purposes of discussion, the microwave frequency device 100 illustrated in FIGS. 10 and 11 is intended to be a directional coupler. It is understood, however, that the various aspects of the present invention have applicability beyond directional couplers. Indeed, among the microwave frequency devices contemplated by the present invention are: couplers (such as directional and bi-directional couplers), power dividers, transformers, phase shifters, frequency synthesizers, frequency doublers, attenuators, filters, etc.

The microwave frequency device 100 preferably includes a first substrate 200 and a second substrate 250 that are bonded together by way of an appropriate film 280 to form a bonded assembly. The first substrate 200 preferably includes a dielectric layer 102 and conductive film disposed on opposing first and second sides of the dielectric layer 102. These features of the first substrate 200 will be discussed in more detail later in this description. The second substrate 250 also preferably includes a dielectric layer 152 and conductive film disposed on at least one of first and second opposing sides thereof. The detailed features of the second substrate 250 will also be discussed later in this description. The conductive film on one of the first and second sides of the dielectric layer 102 is sandwiched between the dielectric layers 102 and 152 to form one or more signal lines.

Preferably, the second substrate 250 includes one or more cut-outs 166, where the dielectric layer 152 and conductive film have been removed. In accordance with one aspect of the present invention, the cut-outs 166 preferably expose portions of the one or more signal lines of the dielectric layer 102 to form microstrip portions. As will be described in more detail hereinbelow, the microwave frequency device 100 is preferably electrically connected to respective traces of a printed circuit board (not shown) by soldering or otherwise connecting the microstrip portions to the traces. Advantageously, this provides reliable, high-power, and tunable connections.

Figure 12:
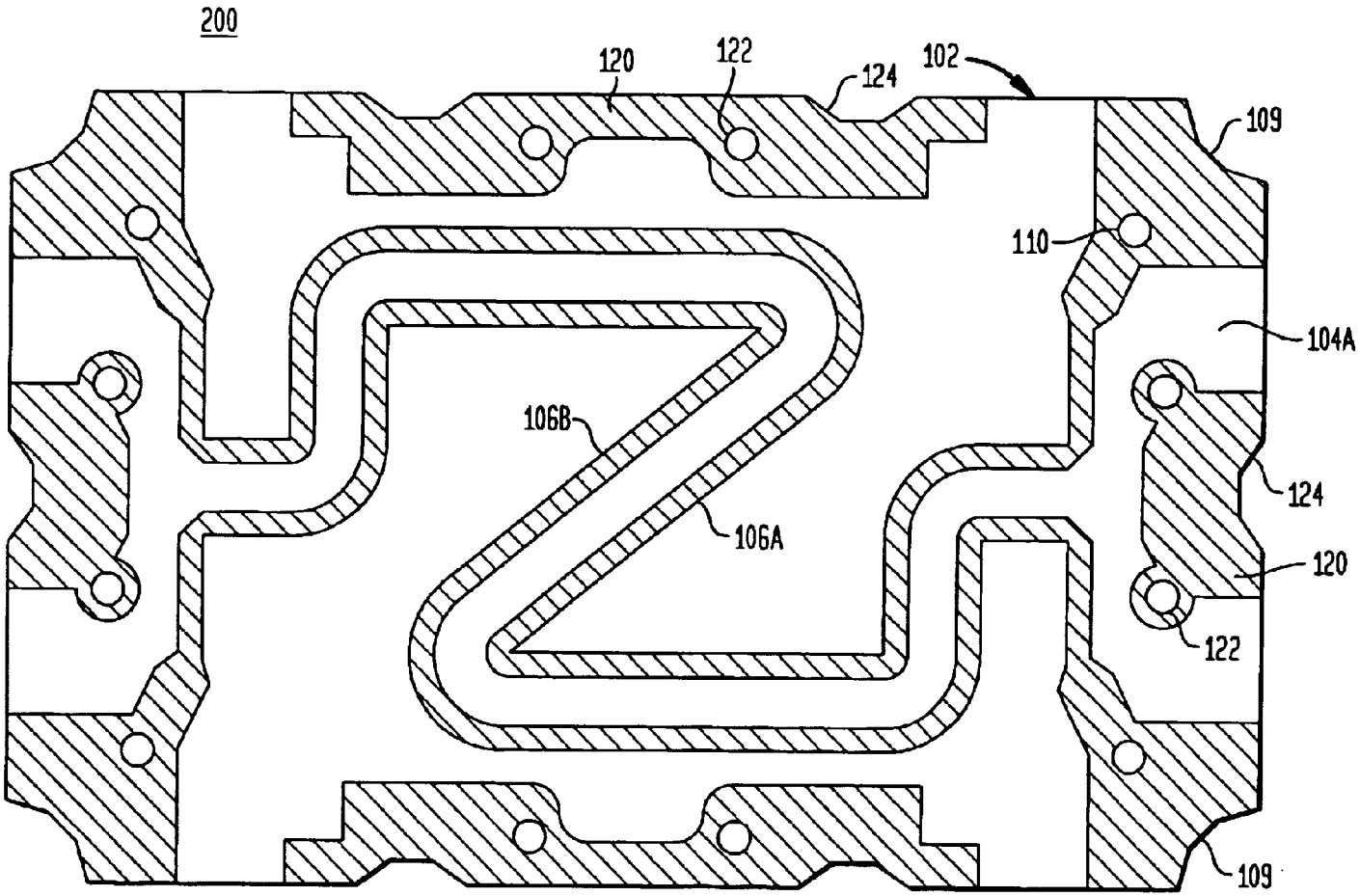
FIG. 12 is a top plan view of a substrate in accordance with one or more aspects of the present invention that is suitable for use in the microwave frequency device of FIGS. 10–11.
Figure 13:
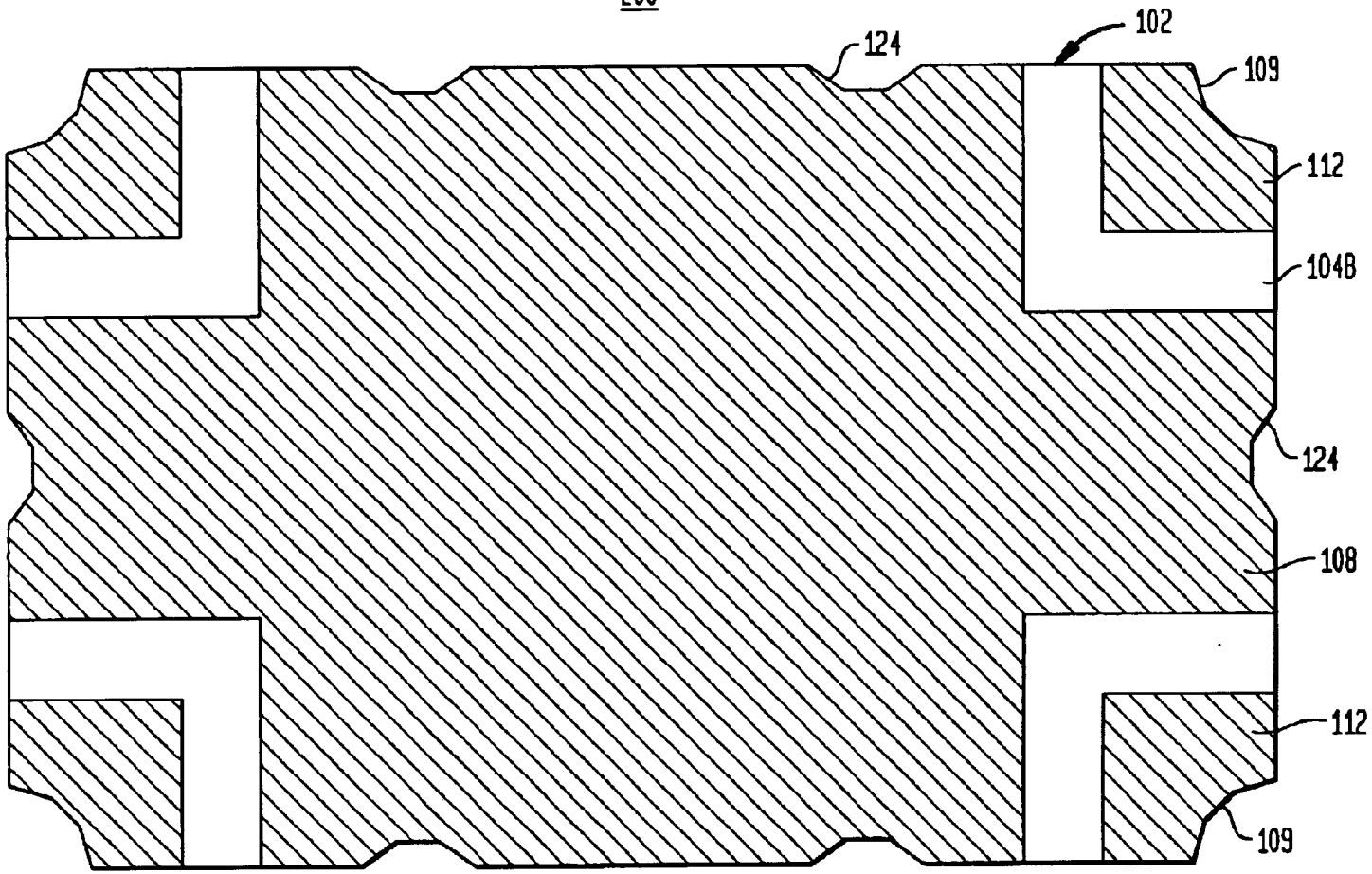
FIG. 13 is a plan view of an opposite side of the substrate of FIG. 12.

Reference is now made to FIGS. 12 and 13, which illustrate top and bottom plan views of the first substrate 200 of FIGS. 10 and 11. The substrate 200 includes a dielectric layer 102 having opposing first and second sides 104A, 104B, respectively. Conductive film is disposed on the opposing first and second sides 104A, 104B of the dielectric layer 102. As best seen in FIG. 12, the conductive film preferably includes at least one planar transmission line (or signal line) 106A. For the purposes of an exemplary discussion, FIG. 12 shows two signal lines 106A and 106B disposed on the dielectric layer 102 in spaced proximity, which is suitable for use in forming a microwave frequency directional coupler. It is understood, however, that the aspects of the present invention described herein are not limited to use in a microwave frequency coupler, but instead have wider applicability to many other microwave frequency devices.

Respective ends of the signal lines 106A, 106B preferably terminate at a periphery of the substrate 200. More particularly, the signal lines 106A, 106B are shown to terminate at respective corners of the substrate 200, where two peripheral edges of the substrate 200 come together. Preferably, the widths of the signal lines 106A, 106B increase near the ends thereof to facilitate proper impedance characteristics, which will be discussed in further detail below.

Additional regions of conductive material 120 may be provided on the first side 104A of the dielectric layer 102. It is noted, however, that these further regions of conductive material 120 are not required to practice the present invention, although they may be preferred. When used, the regions 120 are electrically connected to a ground plane 108 on the second side 104B of the dielectric layer 102 utilizing either plated through-holes, edge plating, or both. This will be discussed in more detail later in this description. As best seen in FIG. 13, the conductive film on the second side 104B of the dielectric layer 102 is preferably formed into a ground plane 108. It is most preferred that isolated portions 112 of conductive film are formed in registration with (or opposite from) the ends of the signal lines 106A, 106B. As will be discussed in more detail later in this description, the isolated portions 112 of conductive film may be connected to the ends of the signal lines 106A, 106B by way of through-holes, edge plating, or both.

Figure 14:
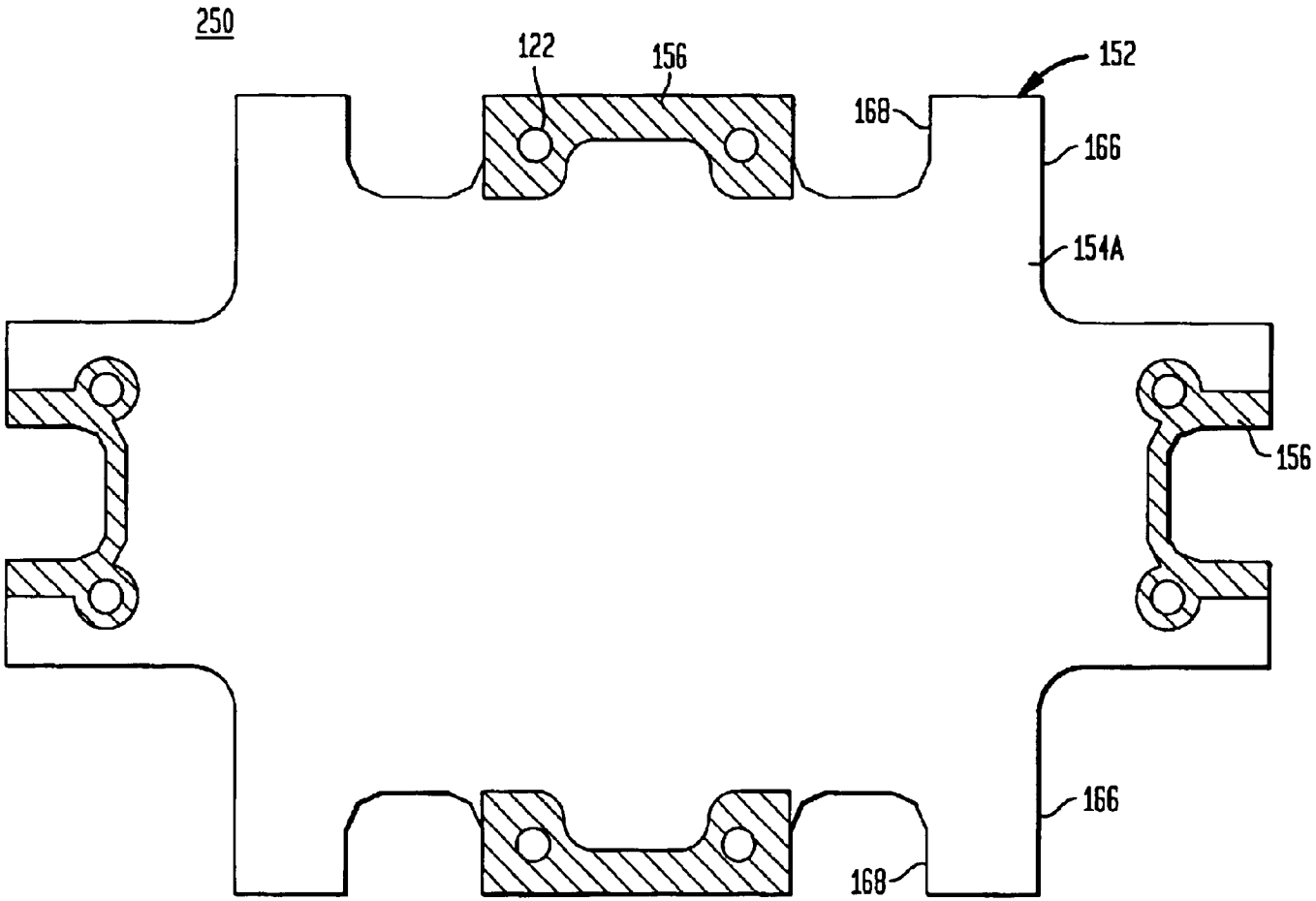
FIG. 14 is a top plan view of another substrate in accordance with various aspects of the present invention that is suitable for use with the substrate of FIGS. 12–13 to form the microwave frequency device of FIGS. 10–11.
Figure 15:
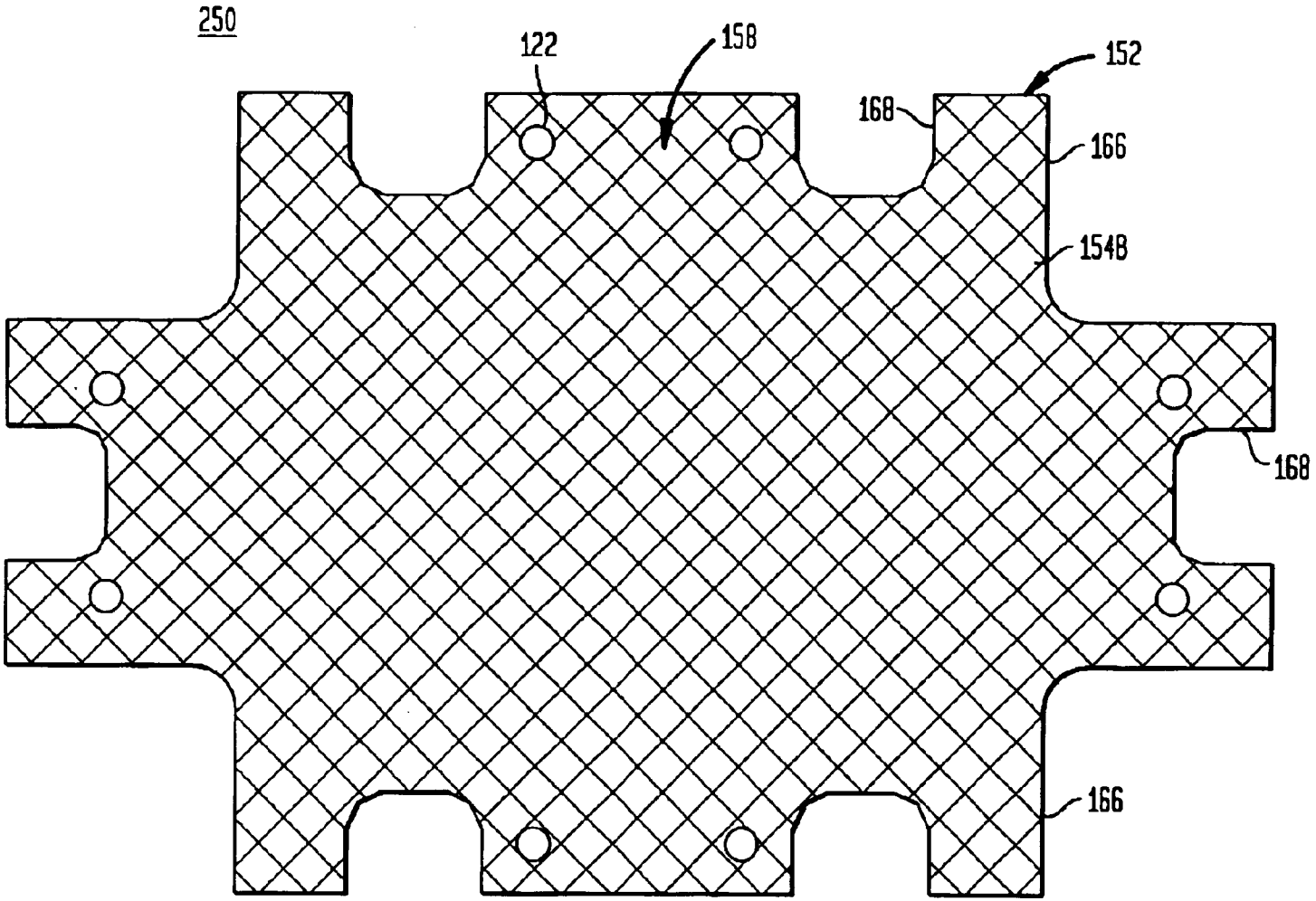
FIG. 15 is plan view of an opposite side of the substrate of FIG. 14.

With reference to FIGS. 14 and 15, the second substrate 250 includes a dielectric layer 152 having first and second opposing sides 154A, 154B, respectively. Although not required, the first side 154A of the dielectric layer 152 may include one or more regions 156 of conductive film. The second side 154B of the dielectric layer 152 preferably includes conductive film forming a ground plane 158. When the regions 156 of conductive material are disposed on the first side 154A of the dielectric layer 152, they are preferably electrically connected to the ground plane 158 on the second side 154B of the dielectric layer 152. This electrical interconnection is preferably achieved either utilizing plated through-holes, edge plating, or both.

The second substrate 250 preferably includes the one or more cut-outs 166 along one or more peripheral edges thereof. For example, one or more cut-outs 166 may be provided at one or more respective corners of the substrate 250. Additionally, although not required, further cut-outs 168 may be provided along other portions of the periphery of the substrate 250.

The first substrate 200 is preferably bonded to the second substrate 250 such that the first side 104A of the dielectric layer 102 opposes the first side 154A of the dielectric layer 152. The cut-outs 166 are preferably in registration with the ends of the signal lines 106A and 106B such that they are exposed in the bonded assembly (FIG. 10) 100. When utilized, the cut-outs 168 are preferably in registration with the further regions of conductive material 120 along the peripheral edges of the dielectric layer 102 when the first and second substrates 200, 250 are bonded together.

Although not required, one or more plated through-holes 110 may be provided through the ends of the signal lines 106A, 106B to interconnect the conductive film on one side of the substrate 100 (FIG. 10) with the isolated portions 112 of conductive film on the opposite side 104B of the dielectric layer 102 (FIGS. 12–13).

When either or both of the further regions 120 (FIG. 12) and regions 156 (FIG. 14) are employed, they may be connected to the respective ground planes 108 (FIG. 13) and 158 (FIG. 15) of the substrates 200, 250 by way of one or more plated through-holes 122. The through-holes 122 preferably extend from the ground plane 108, through the further regions 120, through the regions 156, and to the ground plane 158.

As illustrated in FIGS. 10–13, one or more curved portions 109 are provided in the peripheral edges of the dielectric layer 102 proximate to the ends of the signal lines 106A, 106B. Preferably, edge plating is also (or alternatively) provided to electrically connect the ends of the signal lines 106A, 106B to the corresponding isolated portions 112 of conductive material on the second side 104B of the dielectric layer 102. This edge plating is preferably disposed on the curved portions 109 of the first substrate 200. One or more further curved portions 124 may be provided in the peripheral edges of the dielectric layer 102 proximate to the regions 120. Edge plating may be employed between the regions 120 and the ground plane 108 along the peripheral edge or edges of the dielectric substrate 102. Preferably, the edge plating is disposed on the curved portions 124 to interconnect the regions 120 to the ground plane 108. As best seen in FIG. 10, when the first and second substrates 200, 250 are bonded together, the cut-outs 168 are in registration with the curved portions 124.

As explained above, the microwave frequency device 100 is preferably electrically connected to the respective traces of the printed circuit board by soldering or otherwise connecting the microstrip portions of the signal lines 106A, 106B to the traces. It is most preferred that the electrical connections of the signal lines 106A, 106B to the traces of the printed circuit board are established by soldering or otherwise connecting the edge plated curved portions 109 of the first substrate 200 to the traces of the printed circuit board. Advantageously, this provides reliable, high-power, and tunable connections between the microwave frequency device 100 and the printed circuit board. Owing to the cut-outs 166, the ends of the signal lines 106A, 106B are exposed and actions may be taken to correct for any impedance mismatches resulting from the change in geometry, solder, etc., at the connection of the signal lines 106A, 106B to the traces of the printed circuit board. For example, some of the conductive material at the ends of the signal lines 106A, 106B may be removed or trimmed to correct for impedance mismatches. Alternatively, conductive material may be added in the connection region to correct for impedance mismatches.

Other portions of the microwave frequency device 100 may also be connected to the traces of the printed circuit board. For example, ground connections may be achieved by soldering or otherwise connecting one or more of the edge plated curved portions 124 to respective traces of the printed circuit board. It is preferred that conventional surface mount techniques be employed to connect the plated curved portions 124 (and the plated curved portions 109) to the traces of the printed circuit board.

Figure 16:
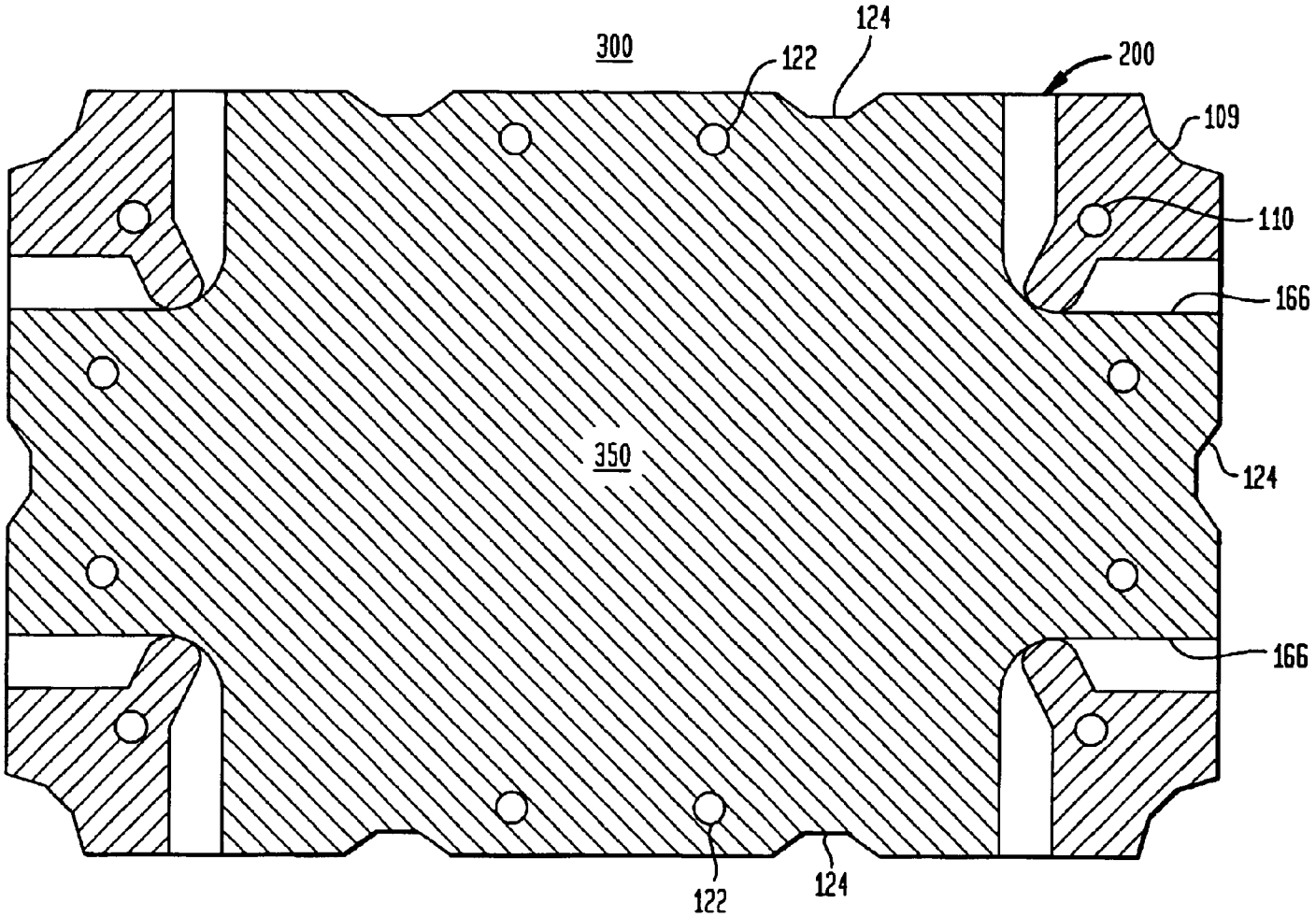
FIG. 16 is a top plan view of a microwave frequency device in accordance with one or further aspects of the present invention.

With reference to FIG. 16, a top plan view of an alternative microwave frequency device 300 in accordance with one or more further aspects of the present invention is shown. The microwave frequency device 300 is similar to the microwave frequency device 100 of FIG. 10, except that the cut-outs 168 are not employed. The microwave frequency device 300 preferably includes the first substrate 200 (FIGS. 12 and 13), and a second substrate 350 that are bonded together by way of an appropriate film to form a bonded assembly. The features of the first substrate 200 have been discussed in detail hereinabove. The second substrate 350 preferably includes a dielectric layer and conductive film disposed on at least one of first and second opposing sides thereof. The detailed features of the second substrate 350 will be discussed later in this description. The signal lines 106A, 106B of the first substrate 200 are preferably sandwiched between the dielectric layers of both substrates.

Preferably, the second substrate 350 includes one or more cut-outs 166, which are substantially similar to the cut-outs 166 of the second substrate 250 discussed hereinabove with respect to FIGS. 14 and 15. Notably, however, the second substrate 350 does not include any other cut-outs, such as cut-outs 168 that were employed in the microwave frequency device 100 of FIG. 10. In accordance with this embodiment of the present invention, the cut-outs 166 preferably expose the ends of the signal lines 106A, 106B to form microstrip portions. As discussed above, the ends of the signal lines 106A, 106B may be electrically connected to respective traces of a printed circuit board by soldering or otherwise connecting the microstrip portions to the traces. As will be discussed in more detail later in this description, other connections (such as ground connections) between the microwave frequency device 300 and other traces of the printed circuit board may be made by soldering or otherwise connecting edge plating at curved portions 124 to such traces.

Figure 17:
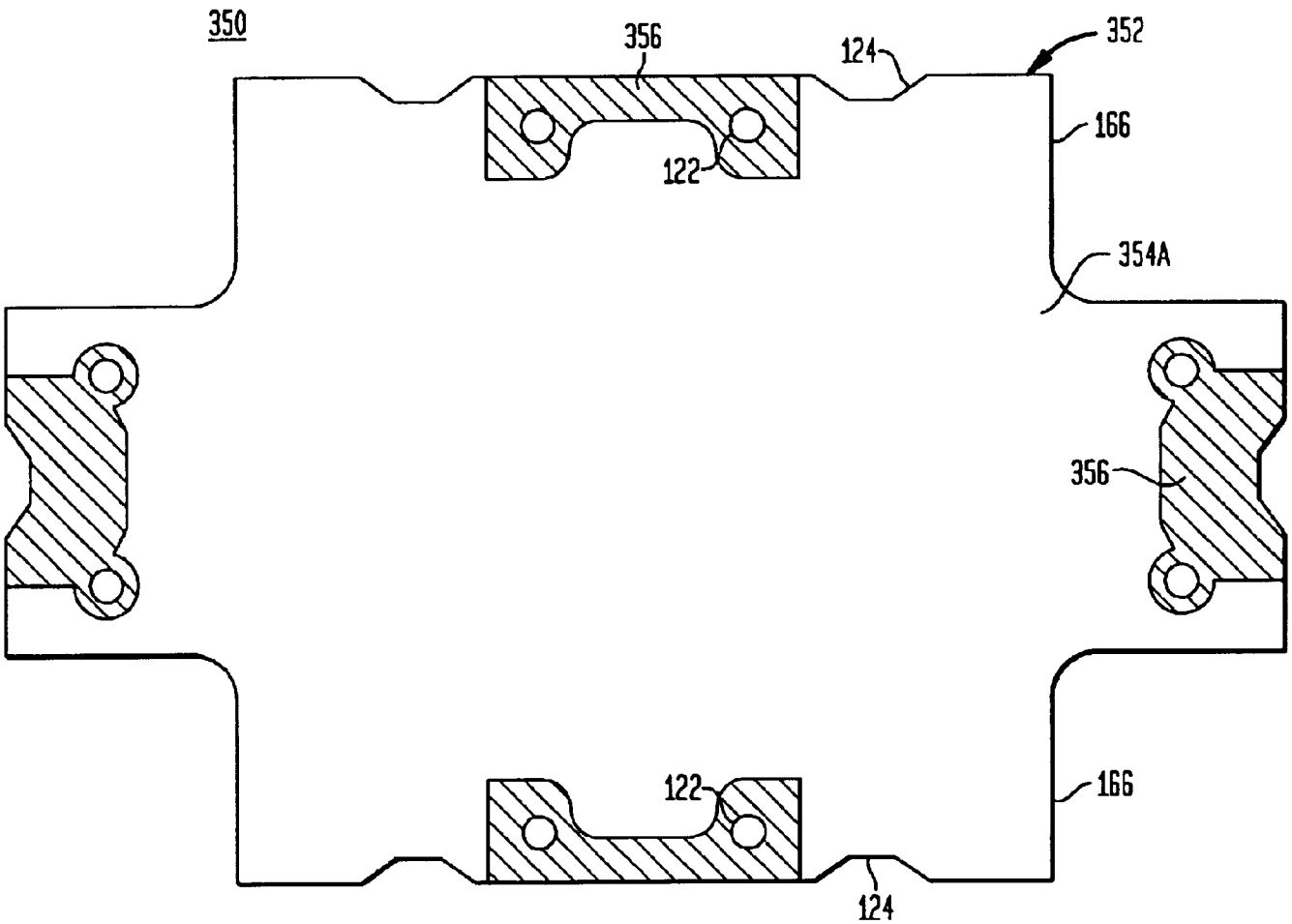
FIG. 17 is a top plan view of an alternative substrate in accordance with further aspects of the present invention that may be used in conjunction with the substrate of FIGS. 12–13 to form the microwave frequency device of FIG. 16.
Figure 18:
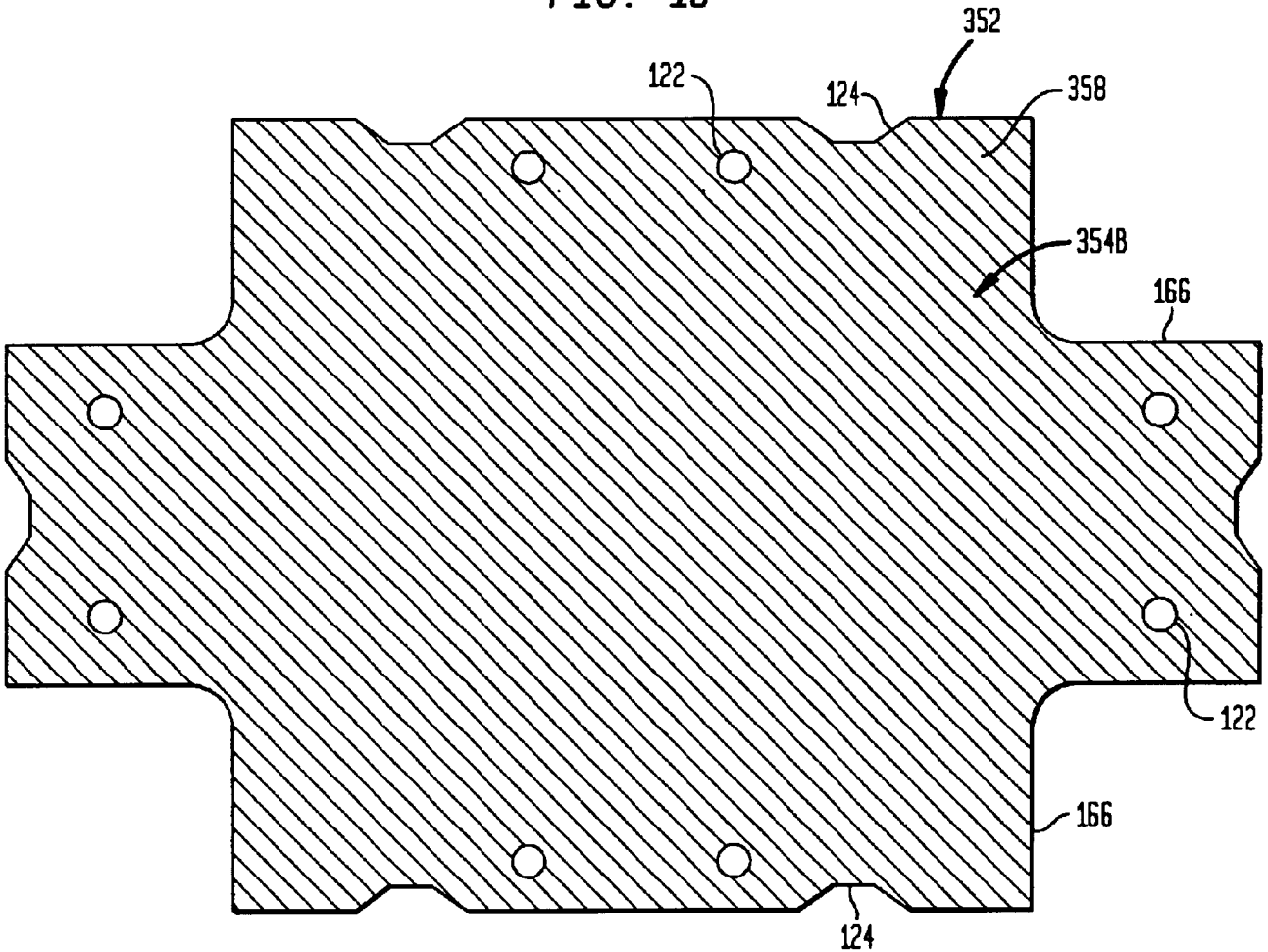
FIG. 18 is a plan view of an opposite side of the substrate of FIG. 17.

With reference to FIGS. 17 and 18, the second substrate 350 includes a dielectric layer 352, having first and second opposing sides 354A, 354B, respectively. Although not required, the first side 354A of the dielectric layer 352 may include one or more regions 356 of conductive film. The second side 354B of the dielectric layer 352 preferably includes conductive film forming a ground plane 358. When the regions 356 of conductive material are disposed on the first side 354A of the dielectric layer 352, they are preferably electrically connected to the ground plane 358 on the second side 354B of the dielectric layer 352. This electrical connection is preferably achieved either utilizing plated through-holes, edge plating or both.

The second substrate 350 preferably includes the one or more cut-outs 166 along one or more peripheral edges thereof. For example, one or more cut-outs 166 may be provided at one or more respective corners of the substrate 350. It is most preferred that the second substrate 350 includes a number of cut-outs 166 that corresponds with a number of ends of the signal lines 106A, 106B that require connection to the printed circuit board. Preferably, no further cut-outs are provided.

The second substrate 350 preferably includes a plurality of curved portions 124 that are disposed along the periphery of the substrate 350. It is most preferred that these curved portions 124 are in alignment with the curved portions 124 of the first substrate 200 (FIGS. 12–13).

The first substrate 200 is preferably bonded to the second substrate 350 such that the first side 104A of the dielectric layer 102 is opposed to the first side 354A of the dielectric layer 352. The cut-outs 166 are preferably in registration with the ends of the signal lines 106A and 106B such that they are exposed in the bonded assembly 300. As discussed above, the curved portions 124 of the second substrate 352 are preferably in alignment with the curved portions 124 of the first substrate 200.

When either or both of the further regions 120 (FIG. 12) and regions 356 (FIG. 17) are employed, they may be connected to the respective ground planes 108 (FIG. 13) and 358 (FIG. 18) of the substrates 200, 350 by way of one or more plated through-holes 122. The through-holes 122 preferably extend from the ground plane 108 of the first substrate 200, though the further regions 120 of the first substrate 200, through the regions 356 of the second substrate 350, and to the ground plane 358 of the second substrate 350.

Edge plating may be employed at the curved portions 124 of the first and second substrates 200, 350 in order to interconnect the ground plane 108 and the regions 120 of the first substrate 200, and to interconnect the ground plane 358 and the regions 356 of the second substrate 350.

As explained above, the microwave frequency device 300 is preferably electrically connected to the respective traces of the printed circuit board by soldering or otherwise connecting the microstrip portions of the signal lines 106A, 106B to the traces. Preferably, these electrical connections are established by soldering or otherwise connecting the edge plated curved portions 109 of the first substrate 200 to the traces of the printed circuit board. Ground connections between the microwave frequency device 300 and the printed circuit board are preferably established by soldering or otherwise connecting one or more of the edge plated curved portions 124 to respective traces of the printed circuit board. It is preferred that conventional surface mount techniques be employed to connect the plated curved portions 124 (and the plated curved portions 109) to the traces of the printed circuit board. Advantageously, this provides reliable, high-power, and tunable connections between the microwave frequency device 300 and the printed circuit board.

While the substrates of the bonded assemblies discussed above, such as substrates 200 and 250 or 200 and 350, may be manufactured individually and bonded together in pairs, it is preferred that an array of first substrates 200 and an array of second substrates 250 or 350 are manufactured and the respective arrays are bonded together. The latter process will now be described in more detail. For the purposes of discussion, the process of forming a plurality of the microwave frequency devices 100 (FIG. 10) will be described, it being understood that the description given has equal applicability to producing a plurality of the microwave frequency devices 10 (FIG. 1) and/or 300 (FIG. 16).

Two panels are provided, where each panel is formed from a dielectric layer having conductive film covering opposing sides thereof. The panels will typically be significantly larger than the individual substrates of a given microwave frequency device. Indeed, each panel is used to form a plurality of the respective first and second substrates 200, 250. Feducial marking is preferably employed to insure that the two panels may be registered with one another in later process steps.

A "step and repeat" photolithographic process is performed to obtain respective arrays of patterns on one side of each of the two panels. In particular, a photo resistive material is placed on the conductive film of each of the panels in respective patterns that correspond with the conductive film patterning shown in FIG. 12 (as to the first of the panels) and FIG. 14 (as to second of the panels). Thereafter, an etching process is carried out to remove portions of the conductive film from each of the panels to obtain an array of areas on each panel containing the requisite conductive material patterns.

Figure 19:
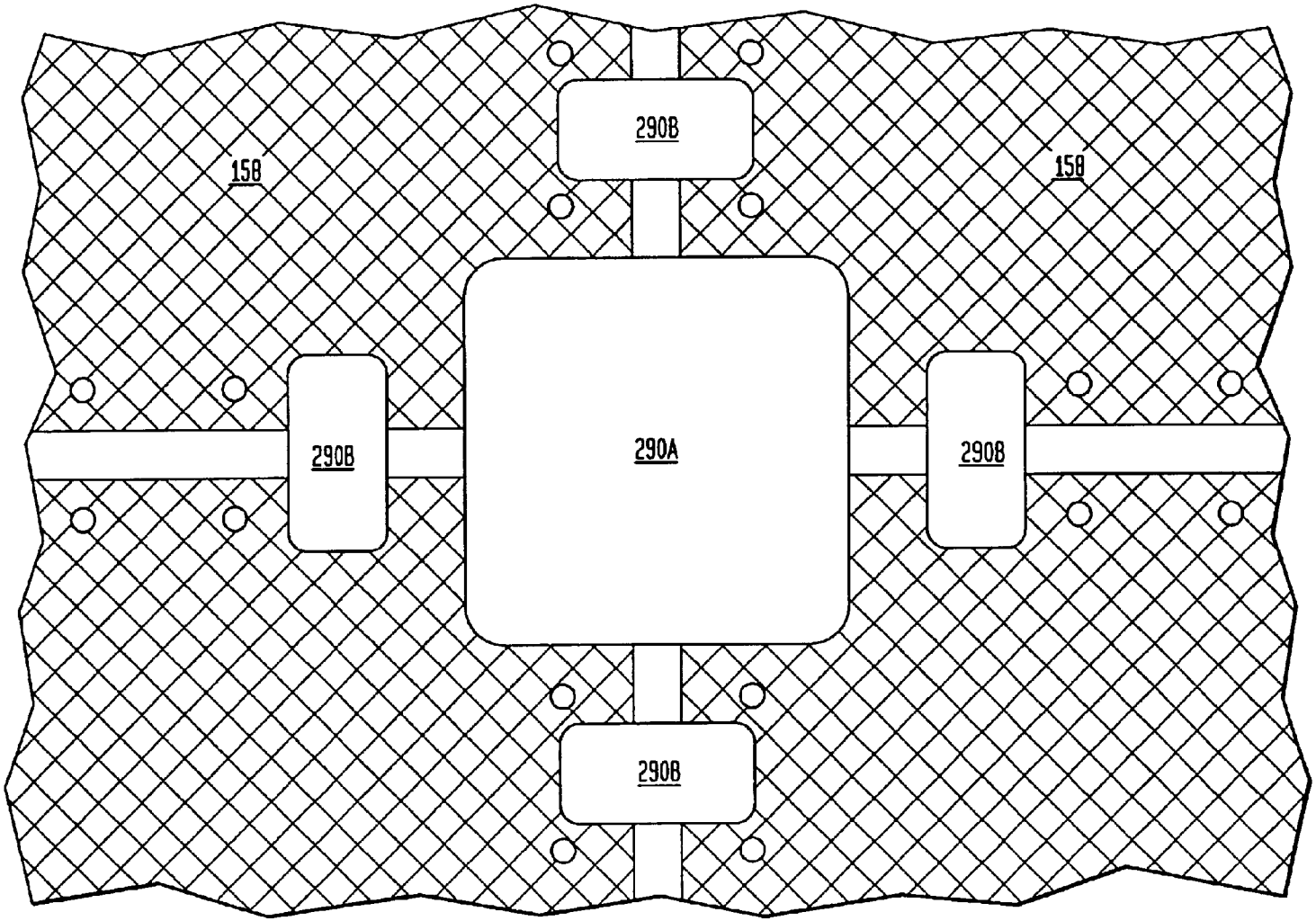
FIG. 19 is a top view of a portion of an array of substrates in accordance with one or more further aspects of the present invention.

Next, apertures are formed in the second panel that correspond with the desired cut-outs 166 in the second substrate 250. With reference to FIG. 19, a top plan view of a portion of the second panel is illustrated, where respective apertures 290A and 290B are formed utilizing any of the known techniques, such as NC machining. The apertures 290A correspond with the cut-outs 166 of the second substrate 250 illustrated in FIGS. 14–15. Preferably, a plurality of such apertures 290A are sized, shaped, and positioned throughout the second panel at appropriate locations among the array of patterned conductive material such that a single aperture 290A will be used to produce a plurality of cut-outs 166, such as four cut-outs 166. It is noted that a single aperture 209A may also be sized, shaped, and positioned for use to produce a single cut-out 166 if desired. A plurality of apertures 290B are preferably made throughout the second panel at positions that correspond with respective cut-outs 168 of adjacent patterns of the array. Those skilled in the art will appreciate from the description herein that the step of forming the apertures 290A and 290B may be performed prior to or after the "step and repeat" photolithographic process described above.

Next, the two panels are bonded together. In particular, a bonding film is placed between the panels and the panels are placed in registration with one another (by way of the feducial markings) such that the respective array patterns of each panel register with one another. It is noted that the bonding film may include respective holes that will align with future through-holes made in the bonded assembly, if such through-holes are employed. The panels are pressed together and subjected to a relatively high temperature to activate the bonding film and form a bonded assembly of the two panels. At this stage, an array of patterns, each having the conductive pattern shown in FIG. 12, and an array of patterns, each having the pattern shown in FIG. 14 are in registration with one another by way of the two panels.

Figure 20:
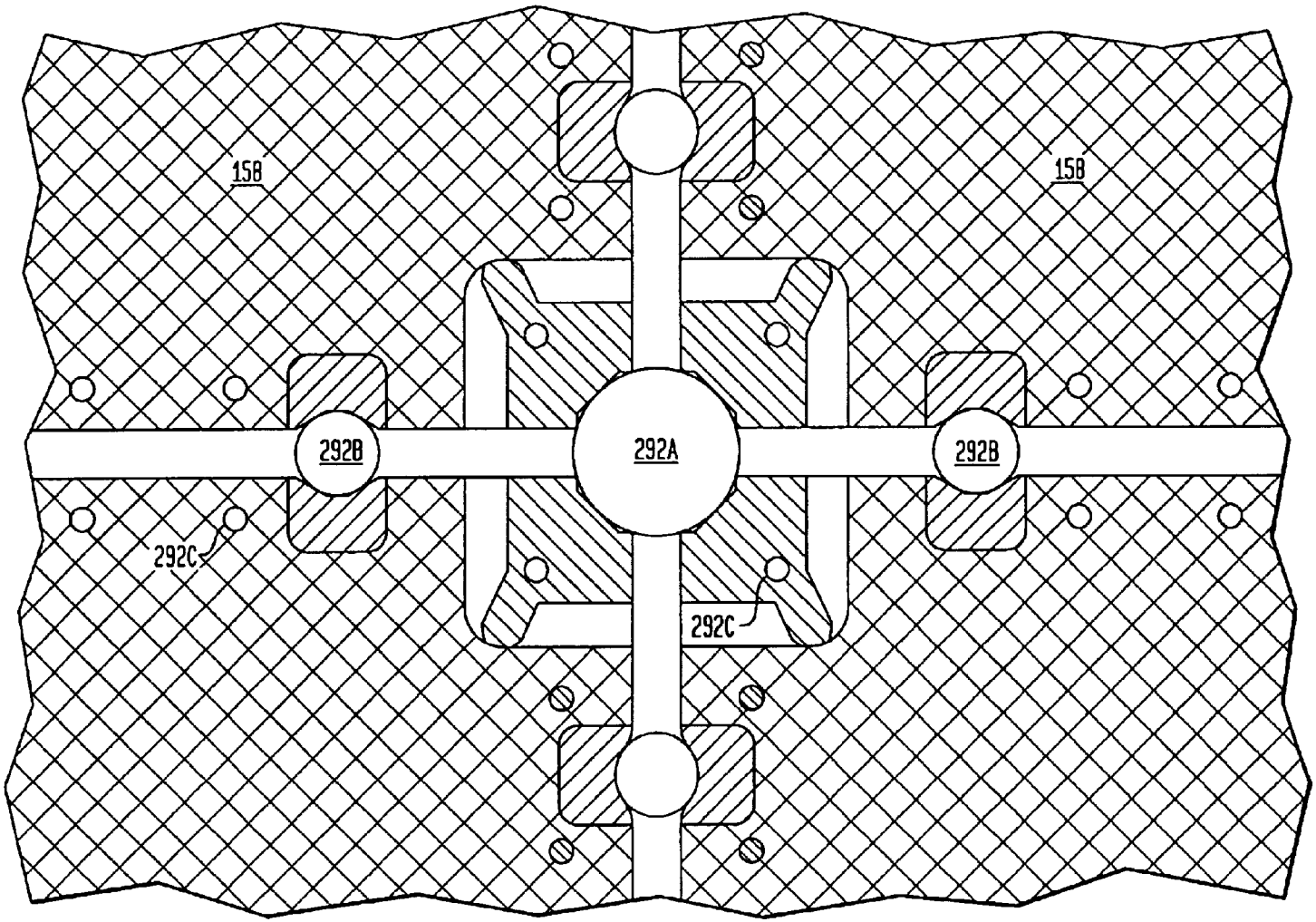
FIG. 20 is a top plan view of the portion of the array of substrates of FIG. 19 in a further stage of manufacture.

With reference to FIG. 20, a plurality of holes 292A are preferably drilled through the first panel at positions that intersect respective ends of the signal lines terminating within the apertures 290A. By way of example, the hole 292A is drilled through the first panel at a position that intersects four ends of respective signal lines 106 that terminate proximate to one another within the aperture 290A. Notably, this creates a rounded portion at each end that corresponds with the rounded portion 109 discussed hereinabove with respect to FIGS. 12–13. Notably, the hole 292A does not pass through the second panel inasmuch as the aperture 290A is in alignment with the position at which the hole 292A is made. Similarly, one or more holes 292B may be formed at locations that correspond with the apertures 290B in order to form respective curved portions 124 described hereinabove. Still further, if plated through-holes are desirable, further holes 292C may be made through portions of the bonded assembly, which may or may not pass through both the panels and which may or may not intersect a signal line 106 depending on the location thereof.

An electroless plating technique is preferably performed to dispose a suitable metal (such as copper, etc.) on the inside surfaces of the holes 292A, 292B, and 292C. Thereafter, electrolytic plating is preferably performed to add additional material to these surfaces to achieve a desired thickness.

Another step and repeat photolithographic process is preferably performed to achieve the desired patterning on the outside surfaces of the bonded assembly, namely patterns that correspond with, for example, the pattern shown in FIG. 13 (as to the first panel) and the pattern illustrated in FIG. 15 (as to the second panel). Of course, other patterns may be used as appropriate. A final plating step is preferably performed to apply an appropriate metal, such as gold, silver, nickel, solder, etc., to avoid oxidation of exposed metalization.

Among the final steps in the process, the respective elements of the array of the bonded assembly are preferably separated utilizing an appropriate cutting technique, such as routing, punching, use of an end mill, laser cutting, etc. With reference to FIG. 20, it is preferred that respective cuts are achieved along the periphery of the array elements to form the desired peripheral edges illustrated, for example, in FIG. 10. Notably, such cutting will result in an exposed plated portion of, for example, hole 292A at the ends of the signal lines 106, which is suited for electrical connection to respective traces of the printed circuit board. Similar plated edges are achieved by way of holes 292B.

While the steps in the process of forming the microwave frequency device 100 were presented in a particular order, it is understood to those skilled in the art that such order was given by way of example only and that different orders may be employed without departing from the spirit and scope of the invention.

Figure 21:
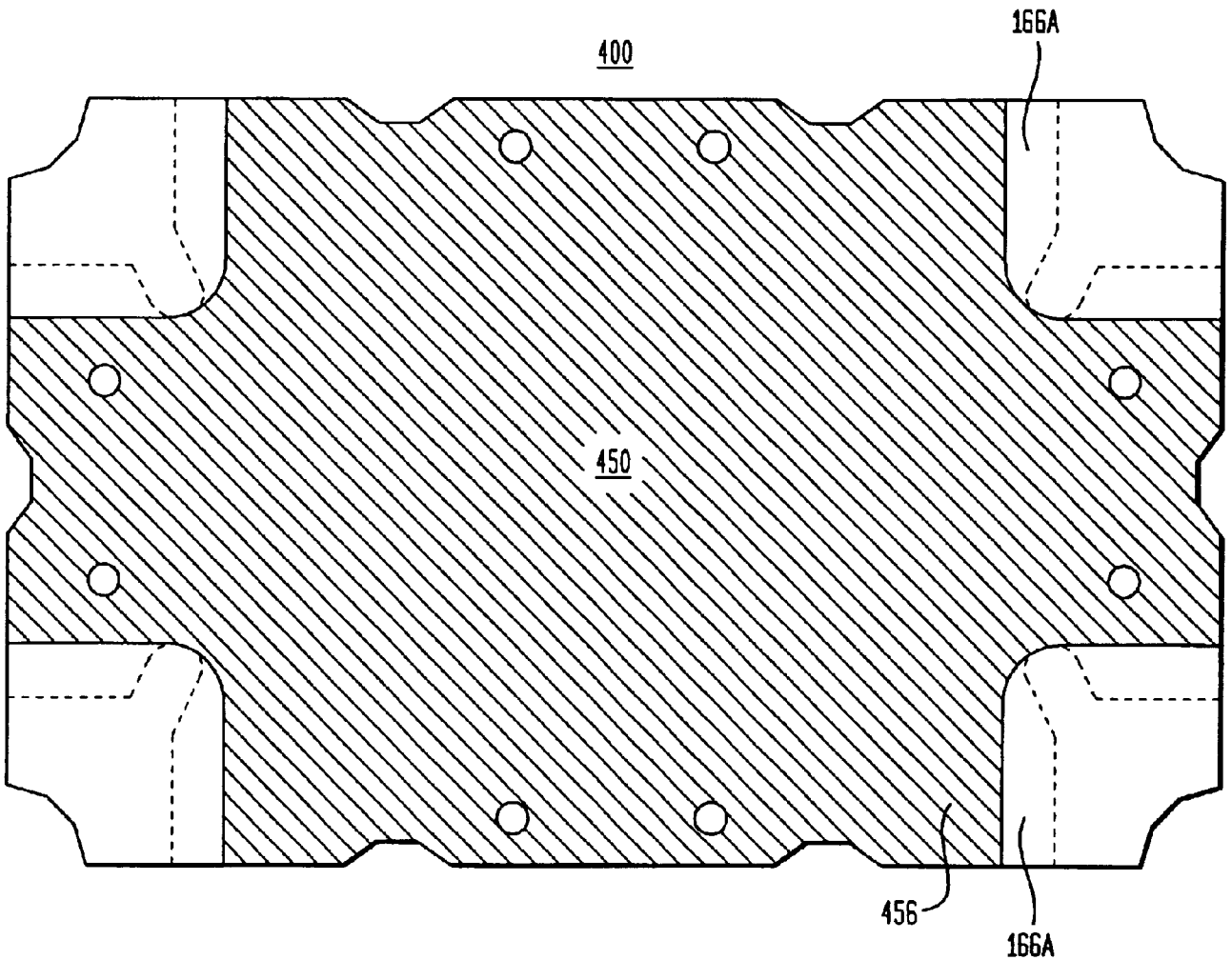
FIG. 21 is a top plan view of a microwave frequency device in accordance with one or further aspects of the present invention.
Figure 22:
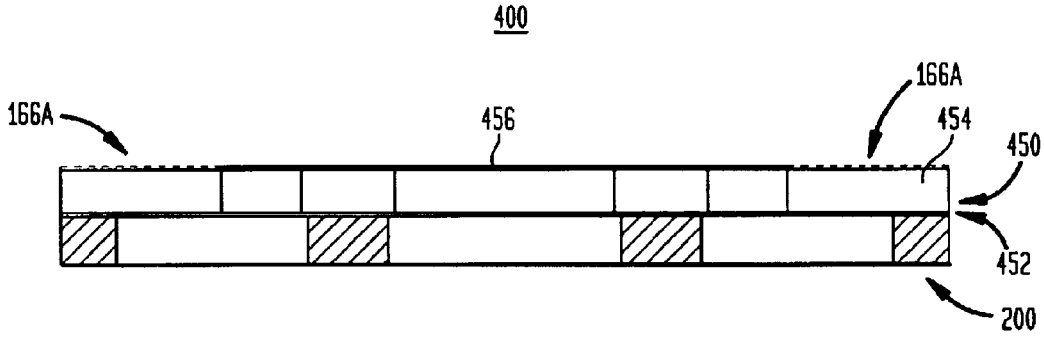
FIG. 22 is a side view of the microwave frequency device of FIG. 21.

Reference is now made to FIGS. 21 and 22, which respectively show a top plan view of an alternative microwave frequency device 400 in accordance with one or more further aspects of the present invention, and a side view thereof. The microwave frequency device 400 is similar to the microwave frequency devices 100 (FIG. 10) and 300 (FIG. 16), except that the cut-outs 166 are not employed. Instead, one or more alternative cut-outs 166A are used, which will be discussed in more detail later in this description.

The microwave frequency device 400 preferably includes the first substrate 200 (FIGS. 12 and 13), and a second substrate 450 that are bonded together by way of an appropriate film 452 to form a bonded assembly. The features of the first substrate 200 have been discussed in detail hereinabove. The second substrate 450 preferably includes a dielectric layer 454 and conductive film 456 disposed on at least one of first and second opposing sides thereof. This construction is very similar to the substrate 350 shown in FIG. 18. The signal lines 106A, 106B of the first substrate 200 are preferably sandwiched between the dielectric layers of both substrates 200, 450.

Preferably, the second substrate 450 includes one or more cut-outs 166A. The cut-outs 166A are formed from an absence of the conductive film 456 on the second side of the second substrate 450. This is best seen in FIG. 22, where the conductive film 456 is shown in exaggerated thickness and as having been removed or otherwise absent at the cut-out areas 166A. In accordance with this embodiment of the present invention, the cut-outs 166A are preferably in registration with the ends of the signal lines 106A, 106B to form the microstrip portions. Indeed, since the conductive film 454 is absent in the cut-outs 166A (even though at least some of the dielectric layer 454 remains), the ends of the signal lines 106A, 106B are not sandwiched between a pair of ground planes as would be the case in a strip line technique.

It is noted that the formation of microstrip portions utilizing the cut-outs 166A is shown having a particular configuration. This is for the purposes of discussion and not by way of limitation. Indeed, this technique may be employed in other embodiments, such as in the microwave frequency device 10 of FIG. 1, in the microwave frequency device 50 of FIG. 2, or in any other suitable microwave frequency device apparent to one of skill in the art in view of the disclosure herein.

As with the other embodiments of the invention, the substrates 200 and 450 of FIGS. 21–22 may be manufactured individually and bonded together in pairs, it is preferred that an array of first substrates 200 and an array of second substrates 450 are manufactured and the respective arrays bonded together. A suitable process for carrying this out was discussed in detail hereinabove with respect to the microwave frequency devices 50, 100, and 300. In this embodiment, however, instead of forming apertures through the dielectric to produce cut-outs 166 as was discussed, for example, in connection with forming an array of second substrates 250 is not performed. Instead, the cut-outs 166A are formed by removing portions of the conductive film 456 but leaving at least some of the dielectric 454. This will look something like the aperture 290A in FIG. 19, however, at least a portion of the dielectric layer 452 will remain, leaving only an aperture through the conductive layer 454.

Any of the known techniques may be employed to produce a plurality of such apertures in the conductive film, such as photolithographic processes, NC machining, etc. Preferably, the plurality of apertures through the conductive film 456 are sized, shaped, and positioned throughout the second panel at appropriate locations such that a single aperture will be used to produce a plurality of cut-outs 166A, such as four cut-outs 166A. Again, this is similar to the process described hereinabove with respect to FIGS. 19–20.

Thereafter, a plurality of holes are drilled through the aperture in the conductive film 456 at positions that intersect respective ends of the signal lines terminating in registration with the apertures. Again, this can be understood in view of the description hereinabove with respect to FIG. 20. By way of example, a hole may be drilled through the aperture and through the first panel at a position that intersects four ends of respective signal lines 106 that terminate proximate to one another within the aperture. An electroless plating technique is preferably performed to dispose a suitable metal (such as cooper, etc.) on the inside surface of the holes. An electrolytic plating technique may also be applied to add additional material to these surfaces to achieve a desired thickness. The respective elements of the array of the bonded assembly are later separated utilizing an appropriate cutting technique in order to obtain the respective microwave frequency devices 400.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of forming a microwave frequency device, comprising:

providing a substrate having a dielectric layer and a conductive film disposed on opposing first and second sides of the dielectric layer, the conductive film on the first side of the dielectric layer including one or more signal lines;

disposing a microwave frequency component, having opposing first and second sides and input/output nodes, onto the first side of the substrate; and coupling the input/output nodes of the microwave frequency component to the signal lines of the substrate such that the one or more signal lines of the substrate form respective microstrip portions.

2. A method, comprising:

providing a first substrate having a dielectric layer and a conductive film disposed on opposing first and second sides of the dielectric layer;

patterning the conductive film on the first side of the dielectric layer of the first substrate to form at least one signal line;

providing a second substrate having a dielectric layer, and conductive film disposed on at least one of first and second opposing sides of the dielectric layer;

removing the dielectric layer and conductive film in at least one region of the second substrate to form at least one cut-out; and bonding the first and second substrates together to form a bonded assembly such that (i) a portion of the signal line of the first substrate is sandwiched between the dielectric layers of the first and second substrates, and (ii) the at least one cut-out exposes a portion of the signal line, thereby forming a microstrip portion.

3. The method of claim 2, further comprising:

forming a through-hole through the first substrate that intersects the exposed portion of the signal line;

plating a sidewall of the through-hole with conductive material to obtain an electrical connection with the exposed portion of the signal line; and cutting the bonded assembly along at least one line that intersects the through-hole to form a peripheral edge.

4. The method of claim 3, further comprising: electrically connecting a remaining portion of the plated sidewall of the through-hole to an external bonding pad to couple the signal line to external circuitry.

5. A microwave frequency device, comprising:

a substrate having a dielectric layer and a conductive film disposed on opposing first and second sides of the dielectric layer, the conductive film on the first side of the dielectric layer including one or more signal lines; and a microwave frequency component having opposing first and second sides, the second side being coupled to the first side of the substrate, the microwave frequency component including input/output nodes coupled to the signal lines, wherein the one or more signal lines of the substrate form respective microstrip portions.

6. The microwave frequency device of claim 5, wherein the substrate is a single layer substrate.

7. The microwave frequency device of claim 5, wherein:

the first and second sides and peripheral sides of the substrate form a first parallelepiped;

the first and second sides and peripheral sides of the microwave frequency component form a second parallelepiped; and at least one peripheral side of the microwave frequency component is not coplanar with a corresponding one of the peripheral sides of the substrate such that the one or more signal lines of the substrate form respective microstrip portions.

8. The microwave frequency device of claim 5, wherein:

the one or more signal lines terminate at a peripheral edge of the substrate; and the peripheral edges adjacent to the signal lines are plated such that they are electrically coupled to the respective signal lines.

9. The microwave frequency device of claim 8, wherein the plated peripheral edges of the substrate adjacent to the signal lines are curved.

10. The microwave frequency device of claim 8, wherein the signal lines are exposed such that tuning actions are permitted after the microwave frequency device is assembled.

11. The microwave frequency device of claim 5, wherein:

the conductive film on the first side of the dielectric layer of the substrate includes at least one ground conductor terminating at a peripheral edge of the substrate and forming a microstrip portion; and the peripheral edge adjacent to the ground conductor is plated such that it is electrically coupled to the ground conductor.

12. The microwave frequency device of claim 11, wherein the plated peripheral edge of the substrate adjacent to the ground conductor is curved.

13. The microwave frequency device of claim 5, wherein the microwave frequency component is one of a coupler, a directional coupler, a bi-directional coupler, a power divider, a phase shifter, a frequency synthesizer, a frequency doubler, an attenuator, and a transformer.

14. The microwave frequency device of claim 5, wherein the microwave frequency component is formed from at least one of a single- or multi-layer low temperature co-fired ceramic structure; a thin/thick film single- or multi-layer on alumina structure; a single- or multi-layer polytrifluoro ethylene structure; a ceramic filled single- or multi-layer polytrifluoro ethylene structure; and a ceramic filled, glass woven, single- or multi-layer polytrifluoro ethylene structure.

15. A microwave frequency device, comprising:

a first substrate having a dielectric layer and a conductive film disposed on opposing first and second sides of the dielectric layer, the conductive film on the first side of the dielectric layer of the first substrate including at least one signal line; and a second substrate having a dielectric layer, conductive film disposed on at least one of first and second opposing sides of the dielectric layer, and at least one cut-out where the dielectric layer and conductive film have been removed, wherein the first and second substrates are bonded together to form a bonded assembly such that (i) a portion of the signal line of the first substrate is sandwiched between the dielectric layers of the first and second substrates, and (ii) the at least one cut-out exposes a portion of the signal line, thereby forming a microstrip portion.

16. The microwave frequency device of claim 15, wherein:

the exposed portion of the signal line terminates at a peripheral edge of the first substrate of the bonded assembly; and the peripheral edge adjacent to the exposed portion of the signal line is plated such that it is electrically coupled to the signal line.

17. The microwave frequency device of claim 16, wherein the plated peripheral edge of the first substrate adjacent to the exposed portion of the signal line is curved.

18. The microwave frequency device of claim 16, wherein the exposed portion of the signal line at the peripheral edge of the first substrate is wider than non-exposed portions of the signal line.

19. The microwave frequency device of claim 16, wherein the at least one cut-out is operable to permit tuning actions to take place at the exposed portion of the signal line.

20. The microwave frequency device of claim 15, wherein:

the conductive film on the first side of the dielectric layer of the first substrate includes at least one ground conductor; and the at least one cut-out of the second substrate includes a cut-out that exposes a portion of the ground conductor.

21. The microwave frequency device of claim 20, wherein the exposed portion of the ground conductor terminates at the peripheral edge of the first substrate of the bonded assembly, the peripheral edge adjacent to the exposed portion of the ground conductor being plated such that it is electrically coupled to the ground conductor.

22. The microwave frequency device of claim 21, wherein the plated peripheral edge of the first substrate adjacent to the exposed portion of the ground conductor is curved.

23. The microwave frequency device of claim 15, wherein the microwave frequency device is one of a coupler, a directional coupler, a bi-directional coupler, a power divider, a phase shifter, a frequency synthesizer, a frequency doubler, an attenuator, and a transformer.

24. A microwave frequency device, comprising:

a first substrate having a dielectric layer circumscribed by a peripheral edge and a conductive film disposed on opposing first and second sides of the dielectric layer, the conductive film on the first side of the dielectric layer of the first substrate including at least one signal line, respective ends of the at least one signal line terminating at the peripheral edge; and a second substrate having a dielectric layer, conductive film disposed on at least one of first and second opposing sides of the dielectric layer, and respective cut-outs where the dielectric layer and conductive film have been removed, wherein the first and second substrates are bonded together to form a bonded assembly such that (i) respective portions of the at least one signal line of the first substrate are sandwiched between the dielectric layers of the first and second substrates, and (ii) the respective cut-outs expose the ends of the signal lines, thereby forming respective microstrip portions.

25. The microwave frequency device of claim 24, wherein the peripheral edge adjacent to the respective ends of the at least one signal line is plated to form respective connection points to the at least one signal line.

26. The microwave frequency device of claim 25, wherein the plated peripheral edge of the first substrate adjacent to the respective ends of the at least one signal line is curved.

27. The microwave frequency device of claim 24, wherein the exposed portions of the signal lines at peripheral edges of the first substrate are wider than non-exposed portions of the signal lines.

28. The microwave frequency device of claim 24, wherein the cut-outs are operable to permit tuning actions to take place at the exposed portions of the signal lines.

29. The microwave frequency device of claim 24, wherein:

the conductive film on the first side of the dielectric layer of the first substrate includes at least one ground conductor; and the cut-outs of the second substrate include a cut-out that exposes a portion of the ground conductor.

30. The microwave frequency device of claim 29, wherein the exposed portion of the ground conductor terminates at the peripheral edge of the first substrate of the bonded assembly, the peripheral edge adjacent to the exposed portion of the ground conductor being plated such that it is electrically coupled to the ground conductor.

31. The microwave frequency device of claim 30, wherein the plated peripheral edge of the first substrate adjacent to the exposed portion of the ground conductor is curved.

32. The microwave frequency device of claim 24, wherein the microwave frequency device is one of a coupler, a directional coupler, a bi-directional coupler, a power divider, a phase shifter, a frequency synthesizer, a frequency doubler, an attenuator, and a transformer.

33. A method, comprising:

providing a first substrate having a dielectric layer and a conductive film disposed on opposing first and second sides of the dielectric layer;

patterning the conductive film on the first side of the dielectric layer of the first substrate to form at least one signal line;

providing a second substrate having a dielectric layer, and conductive film disposed on at least one of first and second opposing sides of the dielectric layer;

removing the conductive film but leaving at least some of the dielectric layer in at least one region of the second substrate to form at least one cut-out in the conductive film but not through the dielectric layer; and bonding the first and second substrates together to form a bonded assembly such that (i) a portion of the signal line of the first substrate is sandwiched between the dielectric layers of the first and second substrates, and (ii) the at least one cut-out in the conductive film of the second substrate is in registration with a portion of the signal line, thereby forming a microstrip portion.

34. The method of claim 33, further comprising:

forming a through-hole through at least a portion of the cut-out in the conductive film of the second substrate and the first substrate that intersects the exposed portion of the signal line;

plating a sidewall of the through-hole with conductive material to obtain an electrical connection with the portion of the signal line; and cutting the bonded assembly along at least one line that intersects the through-hole to form a peripheral edge.

35. The method of claim 34, further comprising: electrically connecting a remaining portion of the plated sidewall of the through-hole to an external bonding pad to couple the signal line to external circuitry.

36. A microwave frequency device, comprising:

a first substrate having a dielectric layer and a conductive film disposed on opposing first and second sides of the dielectric layer, the conductive film on the first side of the dielectric layer of the first substrate including at least one signal line; and a second substrate having a dielectric layer, conductive film disposed on at least one of first and second opposing sides of the dielectric layer, and at least one cut-out formed from an absence of the conductive film, but leaving at least some of the dielectric layer, in at least one region of the second substrate, wherein the first and second substrates are bonded together to form a bonded assembly such that (i) a portion of the signal line of the first substrate is sandwiched between the dielectric layers of the first and second substrates, and (ii) the at least one cut-out in the conductive film of the second substrate is in registration with a portion of the signal line, thereby forming a microstrip portion.

37. The microwave frequency device of claim 36, wherein:

the portion of the signal line terminates at a peripheral edge of the first substrate of the bonded assembly; and the peripheral edge adjacent to the portion of the signal line is plated such that it is electrically coupled to the signal line.

38. The microwave frequency device of claim 37, wherein the plated peripheral edge of the first substrate adjacent to the exposed portion of the signal line is curved.

39. The microwave frequency device of claim 37, wherein the portion of the signal line at the peripheral edge of the first substrate is wider than other portions of the signal line.

40. The microwave frequency device of claim 36, wherein the microwave frequency device is one of a coupler, a directional coupler, a bi-directional coupler, a power divider, a phase shifter, a frequency synthesizer, a frequency doubler, an attenuator, and a transformer.

* * * * *